US005714932A

United States Patent [19]

Castellon et al.

[11] Patent Number: 5,714,932

[45] Date of Patent: Feb. 3, 1998

[54] RADIO FREQUENCY SECURITY SYSTEM WITH DIRECTION AND DISTANCE LOCATOR

[75] Inventors: Roberto J. Castellon; Adrian Dario Recio; Mario Aldo Barrios, all of Miami, Fla.

[73] Assignee: RadTronics, Inc., Miami, Fla.

[21] Appl. No.: 606,736

[22] Filed: Feb. 27, 1996

[51] Int. Cl.[6] ..... G08B 1/08

[52] U.S. Cl. ..... 340/539; 340/571; 340/572; 340/573; 340/825.06; 455/67.1; 342/417

[58] Field of Search ..... 340/539, 573, 340/571, 572, 691, 825.04, 825.06; 455/67.1, 67.7; 342/419, 417, 450, 385, 386

[56] References Cited

U.S. PATENT DOCUMENTS

| | | | |
|---|---|---|---|
| 3,333,271 | 7/1967 | Robinson et al. | 740/571 |
| 4,021,807 | 5/1977 | Culpepper et al. | 340/539 |
| 4,593,273 | 6/1986 | Narcisse | 340/539 |
| 4,598,272 | 7/1986 | Cox | 340/573 |
| 4,747,120 | 5/1988 | Foley | 340/539 |
| 4,899,135 | 2/1990 | Ghahariiran | 340/573 |
| 4,918,416 | 4/1990 | Walton et al. | 340/573 |
| 5,119,072 | 6/1992 | Hemingway | 340/539 |
| 5,289,163 | 2/1994 | Perez et al. | 340/573 |
| 5,423,574 | 6/1995 | Forte-Pathroff | 340/539 |
| 5,428,827 | 6/1995 | Kässer | 340/539 |
| 5,461,365 | 10/1995 | Schlager | 340/573 |
| 5,525,967 | 6/1996 | Azizi et al. | 340/573 |

*Primary Examiner*—Jeffery Hofsass
*Assistant Examiner*—Daryl C. Pope
*Attorney, Agent, or Firm*—Robert C. Kain, Jr.

[57] ABSTRACT

The radio frequency (RF) security system includes a central control unit and a plurality of portable transmitters (up to 128 transmitters) which are in radio frequency communication with the central control unit. This communication is one-way from the portable transmitters to the central control unit. The central control unit and the portable transmitters both include microprocessors and associated memory. Each portable transmitter is assigned a unique unit binary code. In order to detect destruction of the transmitter unit, a powerline is imbedded in an elongated band which is placed on the wrist of a child or attached to an inanimate object. When the band is severed, the powerline is severed and the microprocessor in the portable transmitter is shut down. During normal operation (without the band being severed), the portable transmitter has an RF transmitting circuit which is fed the unique unit code and which frequency modulates (FM) the RF carrier signal with the unit code. The resulting FM signal is transmitted to the central control unit. When power is severed to the microprocessor, the RF transmitter in the portable transmitter continuous emitting an RF carrier signal. The central control unit, in addition to the microprocessor and memory, includes a keypad input device, an antenna system, an RF directional detection circuit, a threshold detection circuit, an identification circuit, distance measuring circuit, and several displays. One display shows the orientation or bearing as well as the distance between the central control unit and each portable transmitter unit. This is accomplished by the directional detection circuit generating phase differential signals which are analyzed by the microprocessor in order to determine the relative position and a distance measuring circuit which determines distance by the relative strength of the received RF signal. The threshold detection circuit determines when the received RF signal fails below a certain threshold. At that time, the threshold detection circuit issues an alarm which stops the scan cycle of the microprocessor. Upon issuance of an alarm, the unique unit code is displayed to the operator so that the operator can easily determine which transmitter has been severed or which transmitter has left the security region (approximately 1,000 feet).

18 Claims, 9 Drawing Sheets

RADIO FREQUENCY SECURITY SYSTEM WITH DIRECTION AND DISTANCE LOCATOR

The present invention relates to a radio frequency (RF) security system with a direction and a distance locator for tracking up to 128 portable transmitters. The security system also includes, in one embodiment, a portable search and locate unit which enables the operator to search for a transmitter that passes beyond the security control area. In one embodiment, that security control area is approximately 1,000 feet.

BACKGROUND OF THE INVENTION

U.S. Pat. No. 5,289,163 to Perez discloses a single child position monitoring and locating device. This device enables the operator to monitor the position of a child within a security control area with respect to the central unit located near the operator. The system utilizes the phase difference between the received signals in order to determine the bearing or orientation of the transmitter carried by the child. The orientation is provided with respect to the central control unit.

U.S. Pat. No. 3,333,271 to Robinson discloses a bearing and frequency measuring system. The Robinson system is utilized to determine the bearing and frequency of a distant transmitter with respect to a central control unit.

U.S. Pat. No. 4,021,807 to Culpepper discloses a beacon tracking system for tracking an RF transmitter hidden within a packet of currency relative to a central control unit.

U.S. Pat. No. 5,119,072 to Hemingway discloses an apparatus for monitoring child activity. The Hemingway system utilizes a transmitter carried by the child. The transmitter includes a microphone. A central control unit has a receiver and a distance detector in order to determine the distance between the transmitter worn by the child and the central control unit. Further, the Hemingway system includes a threshold detector which determines when the child's transmitter is outside the security area.

U.S. Pat. No. 4,899,135 to Ghahariiran discloses a child monitoring device. The central control unit monitors when a transmitter carried by a child leaves the security area.

U.S. Pat. No. 5,423,574 to Forte-Pathroff discloses a child loss prevention system. This system utilizes bar coded bracelets attached to the wrist of a child. The bar code is read by a bar code reader in order to identify the child.

U.S. Pat. No. 4,598,272 to Cox discloses an electronic monitoring apparatus.

U.S. Pat. No. 5,428,827 to Kasser discloses a radio receiver with a radio data signal to a decoder.

U.S. Pat. No. 4,593,273 to Narcisse discloses an out of range personnel monitor and alarm. The system utilizes a central or base unit that transmits a signal at a certain frequency to one or more receivers which are portable and which are attached to the person being monitored. The receiver unit transmits a second signal back to the base or central unit. Distance detectors in the central unit and threshold detectors in the central unit determine the distance between the remote units and the central unit as well as when the remote units leave the security area.

U.S. Pat. No. 4,747,120 to Foley discloses an automatic personnel monitoring system. The Foley system utilizes a telephone linkage and RF communications channel between a bracelet worn by the person being monitored and a central unit electronically connected to the telephone line.

U.S. Pat. No. 4,918,416 to Walton discloses an electronic proximity identification system. This system uses a two-way radio frequency communications channel between the central unit and the portable transmitter/receiver.

OBJECTS OF THE INVENTION

It is an object of the present invention to provide a security system which is simple to use and which can monitor up to 128 portable transmitters within a radio frequency range of approximately 1,000 feet.

It is another object of the present invention to provide a security which operates on the 900 Mhz frequency band.

It is a further object of the present invention to provide an RF security system which displays to the operator both the orientation or bearing of each transmitter, the distance to the transmitter and the transmitter identification or unit code.

It is a further object of the present invention to provide an RF security system which issues an alarm when a portable transmitter passes beyond the pre-established (programmable) security control zone (up to 1,000 feet).

It is a further object of the present invention to provide a security system which enables the operator to identify a transmitter bracelet which has been cut or tampered with.

It is another object of the present invention to provide a security system which includes a portable search and locate unit. This portable search and locate unit can be utilized to seek out and locate portable transmitters that have gone astray, dropped out of the system, or have left the security area pre-established by the RF security system.

SUMMARY OF THE INVENTION

The radio frequency (RF) security system includes a central control unit and a plurality of portable transmitters (up to 128 transmitters) which are in radio frequency communication with the central control unit. This communication is one-way from the portable transmitters to the central control unit. The central control unit and the portable transmitters both include microprocessors and associated memory. Each portable transmitter is assigned a unique unit binary code. In order to detect destruction of the transmitter unit, a powerline is imbedded in an elongated band which is placed on the wrist of a child or attached to an inanimate object. When the band is severed, the powerline is severed and the microprocessor in the portable transmitter is shut down. During normal operation (without the band being severed), the portable transmitter has an RF transmitting circuit which is fed the unique unit code and which frequency modulates (FM) the RF carrier signal with the unit code. The resulting FM signal is transmitted to the central control unit. When power is severed to the microprocessor, the RF transmitter in the portable transmitter continues emitting an RF carrier signal. The central control unit, in addition to the microprocessor and memory, includes a keypad input device, an antenna system, an RF directional detection circuit, a threshold detection circuit, an identification circuit, distance measuring circuit, and several displays. One display shows the orientation or bearing as well as the distance between the central control unit and each portable transmitter unit. This is accomplished by the directional detection circuit generating phase differential signals which are analyzed by the microprocessor in order to determine the relative position and a distance measuring circuit which determines distance by the relative strength of the received RF signal. The threshold detection circuit determines when the received RF signal falls below a certain threshold. At that time, the threshold detection circuit issues an alarm which stops the scan cycle of the microprocessor through the list of stored unit codes in the memory. Further, the central control unit includes a decoder circuit which displays the unit code for each scan. Accordingly, the central control unit includes one display which shows the distance and the orientation of the portable transmitter with respect to the central control unit and a second display which shows the unique code assigned to that portable transmitter unit. Upon issuance of an alarm, the unique unit code is displayed to the operator so that the operator can easily determine which transmitter has been severed or which transmitter has left the security region (programmable up to 1,000 feet). The portable search and locate unit includes a battery which is recharged at the central control unit. The portable search and locate unit includes an RF directional detection circuit, a microprocessor, two displays (one showing bearing and distance and the second showing the scanned transmitter unit code), and various other functions. The microprocessor executes a program for generating all unit codes subject to the search and locate tracking routine.

BRIEF DESCRIPTION OF THE DRAWINGS

Further objects and advantages of the present invention can be found in the detailed description of the preferred embodiments when taken in conjunction with the accompanying drawings in which.

GENERAL SYSTEM DESCRIPTION

Figure 1:
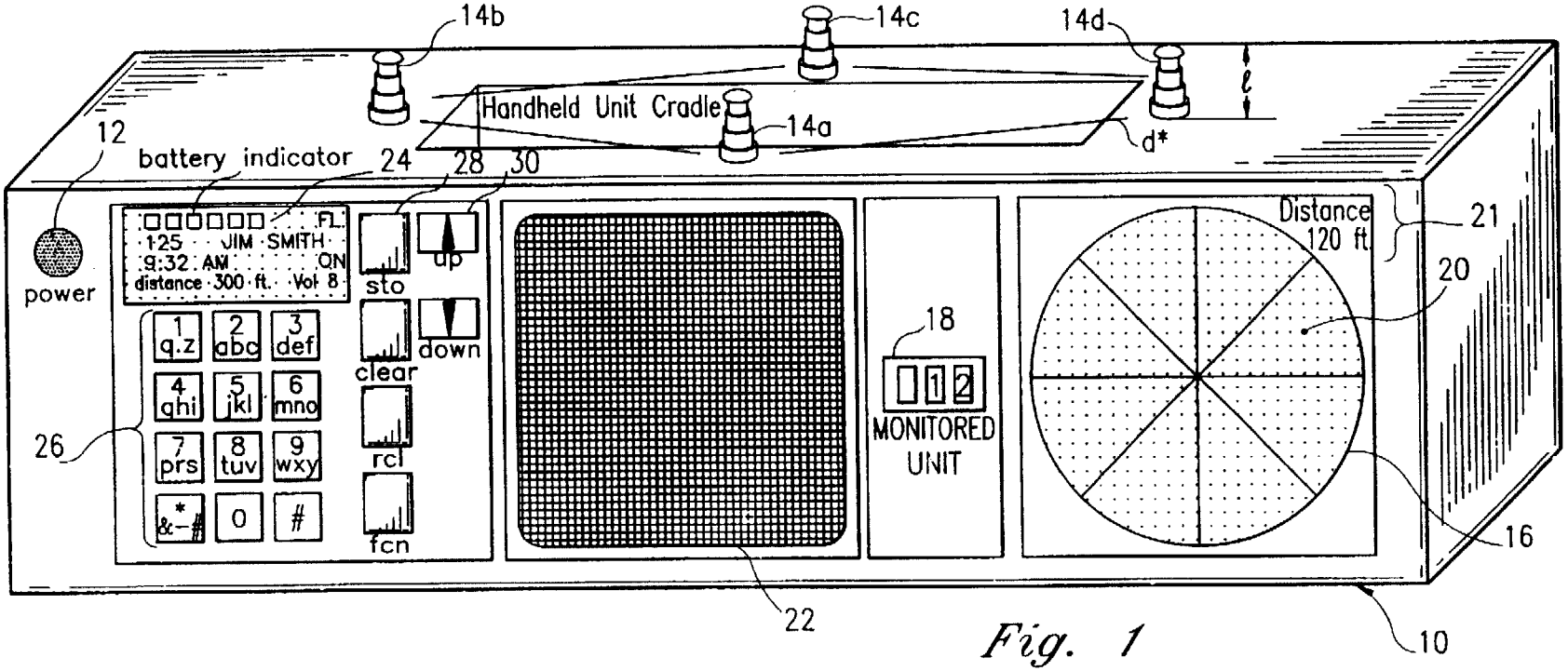
FIG. 1 diagrammatically illustrates one embodiment of the central control unit.

A multiple object monitoring and locating device (to a maximum of 128 individuals, children or animals), monitors the position and distance of those objects by detecting the signal phase, and signal strength of a radio frequency carrier, modulated in FM with an identification binary code, on the band of 900 MHz coming from a transmitter attached as a bracelet on the arm or on the ankle of the wearer or object. The device has an LCD display with a circular graticule, graduated as to angle orientation between the central control unit and the transmitter, to enable constant monitoring of the related direction of different transmitters. Additionally, the distance of said transmitters can be viewed digitally in the upper fight corner of the same LCD graticule. It then becomes possible to view both distance (in feet) and bearing within the same LCD. The equipment also has three 7-segment LED's for establishing the decimal number corresponding to the binary code as an identification for each transmitter. This central unit has also an alarm system circuit that allows the user to hear an audio alarm via a 4" speaker on the front panel, and a visual alarm showing the flashing number of the transmitter (via the 7-segment LED's) that has left the programmed distance range preset on the equipment.

This monitoring system also has a portable finder or locator unit as an optional feature. It is smaller and less sophisticated than the central unit, with rechargeable batteries, so the user is able to walk with the unit in hand, while monitoring point to point the missing transmitter relative to distance and bearing.

System Features

In contrast with other similar equipment, this equipment has the following distinctive features:

a) Unlike other monitoring equipment that can only monitor one or two transmitters, this equipment is capable of controlling and locating up to 128 transmitters simultaneously.

b) The transmission of a unique and non-transferable binary code for each transmitter used in this monitoring system protects against a transmitter being removed and placed within the pre-established distance range, thereby not triggering the alarm, as is the case with other equipment. In this system, intentional removal of the transmitter by cutting the bracelet to confuse the system will cause a loss of the binary code transmission, activating the alarm even in the event that the transmitter is within the appropriate range. By means of the transmission of a unique radio frequency used for each bracelet, the system can still determine the bearing and distance of the removed transmitter.

c) This system allows for constant monitoring of the distance and bearing of all transmitters at all times, independently of whether the alarm has been activated or not.

d) The use of an attached portable unit allows the user to walk towards the missing transmitter, monitoring bearing and distance, while the central unit continues to monitor the other transmitters within the system.

e) Audio and visual alarm outputs in the rear panel of the central unit provides the possibility of using an external audio amplifier, and external lighting, both of greater power. This will allow the user to see and hear the alarm while being away from the central unit.

Individual Bracelet Transmitter

Each bracelet transmitter is unique, with its own individual transmission code, a radio frequency carrier, and a magnetic bar code that will be utilized to identify that particular bracelet. Each central control system, comprised of three parts or units, can track up to 128 individuals or bracelets simultaneously.

The bracelets/transmitters will have the following characteristics:

a) They will be tamper-proof. They cannot be removed manually, but will have a security locking system. This will avoid accidental removal or removal with malicious intent.

b) Unlike any other monitoring system, the transmitters will have magnetic strips under the casing in the event that magnetic detectors (alarms) are to be used at the exits. The magnetic bar code are to be used at the exits. The magnetic bar code and the number on the back of the bracelet will allow the identification of the transmitter when used in conjunction with other optional exit security systems.

c) Each bracelet will have its own unique binary code and unique predetermined carrier radio frequency which cannot be transferred to, or confused with, any other bracelet. This will distinguish any bracelet and its wearer from all other bracelets at all times.

d) The bracelets will be constructed of a durable, non-toxic material. This material will not be harmful to the wearer.

e) They will be waterproof.

f) They will have a small, unbreakable compact casing, within which the transmitter (including batteries and all related circuits) will be placed.

g) The adjustable bracelet will perform the function of antenna for the transmitter.

h) Three nickel cadmium or lithium cells will be the power supply of the transmitter.

i) The transmitter maximum power output will be up to 0.5 watts.

j) The central control system will accept up to 128 bracelets/transmitters.

k) Frequency modulation will be used in the transmission.

l) The band frequency that will be used for the carrier will be from 902 to 927.4 MHz.

m) In the event that the bracelet is cut with a special tool, the unit will no longer transmit the binary code, but will continue to transmit a radio frequency (the RF carrier continues), thereby setting off the alarm in the central control unit and allowing for continued tracking of the transmitter. In this event, the central control unit will not be able to identify the bracelet, only its bearing and distance.

Central Control Unit

The central control unit will have the following characteristics:

a) This unit will permanently and continually monitor all bracelets, or transmitters, in use within the system, up to 128 bracelets. In the event that any of the bracelets are tampered with, destroyed, cut, or removed intentionally or unintentionally from the predetermined programmed control area, a visible and audible alarm will be activated within this central control unit. Additionally, three 7-segment LEDs, also on the central control unit, will identify by number the wearer of the bracelet that has set off the alarm.

b) The central control unit will have a programmable control input via a keypad which will indicate to the system the number of bracelets that are being utilized at any given point in time. Although the system will have a capacity of 128 bracelets, the user may activate any number of bracelets from 1 to 128.

c) The central control unit will have an LCD screen with a directional indicator for monitoring all transmitters that are activated. In case of an alarm, the screen will lock onto the bracelet that has set off the alarm until the system scan is reset.

d) The LCD on the central control unit will also indicate the distance of the transmitter being monitored at any given point in time. In case of an alarm, it will lock onto the transmitter that activated the alarm.

e) The central control unit will have a 3-segment LED to indicate the number of the unit being monitored at any given point in time. In case of an alarm, it will lock onto the identification (binary) code of the transmitter that activated the alarm and flash that number.

f) The central control unit will have a digital control or input (by keypad) to establish the maximum distance from said unit (in feet) which needs to be monitored. This feature allows for changing the control area to suit the user's particular needs.

g) The central control unit will have rechargeable long-lasting batteries. In the event of a power outage, or of no access to electrical outlets, the system may still be employed.

h) The central control unit will have a keypad to input a personal identification number by the user in order to access all controls, such as the on/off switch, alarm volume control, distance control, bracelet disconnection control, bracelet number and corresponding name entry control, etc. The ID number is a security measure to make certain that no person lacking proper authority may enter the system to make any changes in the settings. Central unit display indicator with associated keypad and functions are shown in the figures.

i) The rear panel will have an audio alarm output jack and a light alarm output jack. This will allow for alarm warnings throughout a building.

j) The rear panel will have a DC power supply outlet for recharging the interior battery or for activation via a vehicle battery. This could be particularly useful on field trips.

The central control unit will have rechargeable batteries through an AC or DC supply. This allows for outdoor use of this system. Some outdoor uses are school field trips, in amusement parks, national parks, recreational areas, campgrounds, backyards, and other outdoor areas where it is necessary to monitor a number of children simultaneously. Regardless of the size or area of the park, this system will regulate or limit the movement of the wearers by its programmed distance +/−1,000 feet. By increasing transmitter power, this equipment can be modified to be used for greater distance. The hand held unit (see portable control unit as follows) can still be used in tracking the transmitter that has left the pre-established field of movement.

Portable (Hand Held) Locator Control Unit

Above the central control unit, in a built-in compartment, a portable or hand held locator control unit will be permanently connected. This unit will be powered by rechargeable, long-lasting batteries that will be charged by the central control unit while the hand held unit is in the compartment.

Figure 3:
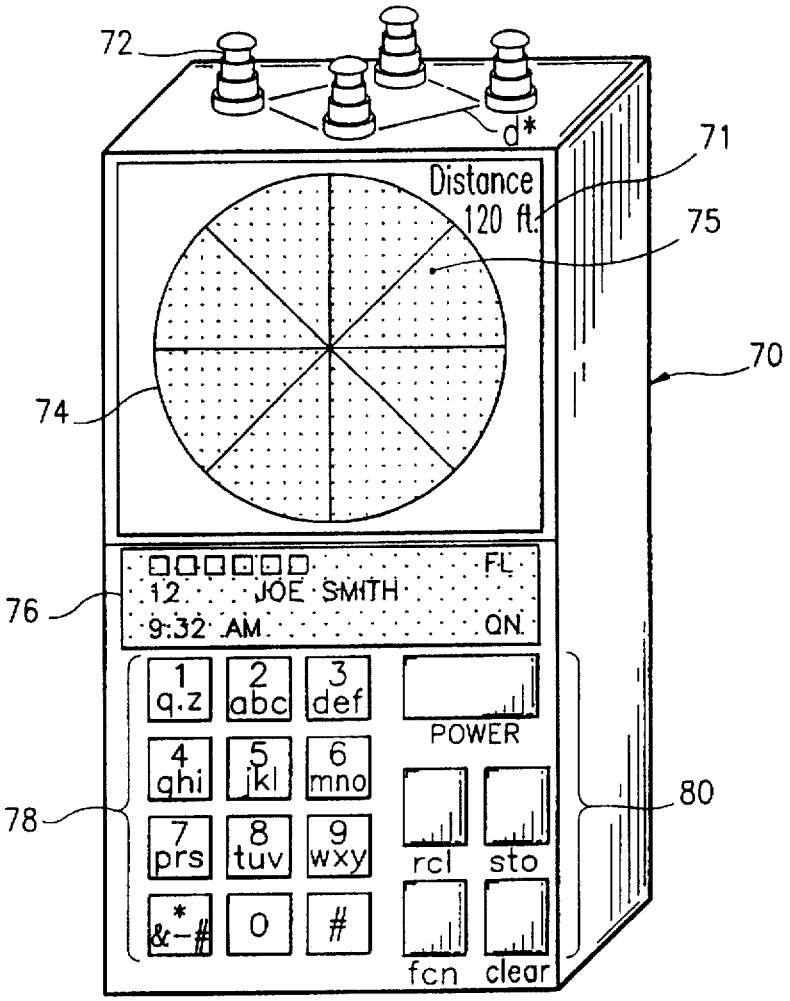
FIG. 3 diagrammatically illustrates the portable (hand held) locator control unit.

The hand held control unit will have the following characteristics:

a) The hand held control unit will be easily programmed by the user so it will key in on or single out the bracelet whose number has been entered. The user will be able to know the approximate direction and distance of said bracelet (transmitter) and travel towards it once the hand held unit has been programmed to do so.

b) The unit will be easily removed from its cradle on the central control unit.

c) The user will be able to enter the transmission code belonging to the bracelet that set off the alarm on the central control unit. Said number will be obtained from the 7-segment LED display on the central control unit, which will reveal the number along with the name of the wearer immediately upon the activation of the alarms. Once the code is entered, the hand held unit will be exclusively sensitive to that bracelet and its code.

d) This unit will be displaying the approximate distance and direction of the bracelet or transmitter which has been programmed while the user is moving towards it, via an LCD screen with a circular graticule and distance indicator as shown in FIG. 3 of the electronic specifications.

e) As a result of its portability this unit will allow unlimited movement in locating the transmitter.

f) The portable control unit has greater sensibility, or range, than the central control unit.

g) The portable control unit does not have an audio or visual alarm, nor a code detector.

Description of Transmitter

The bracelet or transmitter unit will transmit the RF carrier with a maximum power of up to 500 Milliwatts on the band frequency of 900 MHz, with a binary code identification modulating in FM. This will enable the central control unit to monitor its position and distance wherever located within RF range. Each of the maximum 128 transmitters will have a unique identification code, a particular RF carrier, and a bar code corresponding to a decimal number engraved with magnetic paint so that there is no possibility of confusion among the transmitters.

A microcontroller will provide through an interface the identification binary code of the transmitter to a modulated oscillator, which is a variable oscillator combined with an isolation and amplification circuit. This modulated oscillator, with a crystal oscillator, the phase detector, and the associated filters will provide the IF modulated in frequency. An upconverter will carry this frequency up to the transmission frequency obtained through the harmonic generator of the crystal oscillator. A driver will provide the proper signal level to excite a final amplifier capable of giving the power level required through a small antenna, which will be located inside the adjustable bracelet band.

The transmission frequencies of said bracelets will begin at 902 Mhz, being separated by 200 KHz. The last possible bracelet (128) will be in the frequency of: 902 MHz+200 KHz×127=902 MHz+25.4 MHz=927.4 MHz. The width band of each transmitter will be 100 KHz to avoid possible interference among them.

Description of Central Control Unit

This multiple object monitoring and location equipment utilizes two pair of orthogonal antenna arrays (see FIG. 1) in order to receive the radio frequency of the transmitter that is being monitored.

Each of these four antennas feeds into a double conversion FM receptor. These four RX are of identical construction, and the two local oscillators for double conversion feed the four receptors with the same frequency in such a way that the radio frequency phase received is not disturbed in the double conversion through the four channels.

The two primary receptors fed by antennas A (14*a*) and B (14*c*) will produce two signals with phase differences (with respect to each other). These two signals are introduced into a phase detector to determine its phasorial value. These phasorial values are processed by a microcontroller, which will assign a digital number that will represent one of the Cartesian coordinates. In the same fashion, the other two signals received by antennas C (14*b*) and D (14*d*) and their respective receptors are introduced into a second phase detector identical to the prior one, which will give two new phasorial values to the same microcontroller in such a way that it will assign another digital number that will represent the other Cartesian coordinates. In this way, at the microcontroller output, we will have two digital values, each of which will represent one of the Cartesian coordinates of the received radio frequency at that moment. These digital values will then be converted into analog by two digital analog converters (DAC), and then will be run through two linear amplifiers to increase the analog signal in order to excite the LCD circular graticule.

These two analog signals (x,y) will correspond with the Cartesian coordinates of the transmitter being monitored at that time, and are introduced through axes x and y into a quartz liquid display (LCD) which will have a graduated (with respect to angle) circular graticule, as shown in FIG. 1, in such a way that if no signal is received the LCD will show a point in the center of the screen. Upon receiving one of the monitored signals this point will move away from the center with a determined direction. The direction or bearing will indicate to us the orientation of the monitored transmitter TX; in other words, in which direction it can be found.

As explained previously, this equipment has four identical double conversion FM receptors in order to avoid the loss of the RF carrier phase relation. Each receiver RX has a vertical telescopic antenna so that all four antennas are the same size and placed in an orthogonal position (as demonstrated in FIG. 4) and separated by a distance of $\leqq\lambda/2$. The size of each of these will be a few centimeters, complying with the relationship of $1<<\lambda$, where lambda will be the longitude of the wave of the radio frequencies in which the monitoring equipment will work. Each RX has the following parts: (1) antenna, (2) coupling circuit, (3) RF amplifier, (4) first mixer, (5) first local oscillator (synthesizer), (6) first FI amplifier, (7) second mixer, (8) second local oscillator, and (9) second FI amplifier.

The coupling circuit will be of the inductive type, and the coupling factor that will be chosen will be low to avoid antenna influences in the tune circuits of the receptor. The main functions of this circuit will be (a) to couple the antenna to the RF amplifier; and (b) to limit in frequencies the receptor input, in order to avoid interferences.

The RF amplifier will be a tuned amplifier with an approximate bandwidth of 26 MHz, capable of amplifying the 128 RF carriers spaced at 200 Khz each. Some of their functions will be: (a) to reduce spurious signal action or undesirable interferences in the receptor; (b) to reduce by means of attenuation the radiation of the first local oscillator, so as not to interfere with nearby receptors; (c) to increase the sensibility of the receptor by amplifying only the desirable frequencies; and (d) to improve the signal to noise ratio (S/N) of the RX. This RF amplifier should be of a low noise type in order to be able to improve this relationship.

The mixer is the stage that will translate the RF carrier to a lower fixed frequency, called intermediate frequencies (IF), granting the receptor greater stability and allowing the amplifiers to work in lower non-audible frequencies with greater gain and greater selectivity. This mixer has two inputs, one for the RF carrier, and another for the local oscillator. In the case of the first local oscillator, a digital frequency synthesizer will be used. The formula used to obtain this fixed frequency, called IF, will be:

[IF=F signal−F Oscillator] and in this first frequency conversion, we assign it the value of 20.7 MHz.

The IF amplifier is the next stage, and is in charge of providing to the receptor its high gain and selection characteristics. Since this IF amplifier works at a much lower frequency, there will be an increase in its capacitive reactance, decreasing feedback in the amplifier and at the same time increasing the gain. Additionally, by moving to a lower frequency, the selectivity of the IF amplifier increases due to $\Delta f$=FT/Q, where FT is the working frequency (which in this case is the IF) and Q is the quality factor of the circuit, allowing for a smaller bandwidth, resulting in greater selectivity.

In our case, the receptor should be of a double conversion type, since we are working in higher frequencies in to 902 to 928 MHz band. It is impossible for the coupling input circuit to eliminate image frequency, because this frequency is very close to the working frequencies of the receptor. It is then necessary to make another frequency change, or conversion, in order to guarantee the elimination of image frequency and the intermodulation products. In this way, we maintain the characteristics of the receptor with respect to high stability, high gain, and high selectivity.

Another mixing stage with a second local oscillator is then necessary. This oscillator is with a crystal in the 10 MHz frequency. Performing the second conversion gives us the following: FI=FS−Fosc=(20.7−10.0 MHz), or a second IF of 10.7 MHz typical of FM receptors. We then use a second IF amplifier tuned to 10.7 MHz with a bandwidth of 100 Khz, which is necessary to maintain the previously explained characteristics with respect to gain, selectivity and RX stability.

Main Microcontroller Circuit

The main microcontroller circuit used in this central monitoring unit is widely used in other commercial equipment such as cellular telephones, with an associated LCD display and a keypad as shown in FIG. 1. It has up to 128 memory cell capacity that allows for storage of up to 8 digits (in order to store code and frequency of the transmitter) and 10 letters (to identify the wearer by name with the corresponding code). The functions that this microcontroller performs via the keypad, the indicators on display, etc., are shown in the drawings.

Programmable Synthesizer

Since this equipment needs a maximum capacity of automatically monitoring 128 FM transmitters in the 902 to 927.4 MHz range spaced at 200 KHz, it is necessary to utilize a device capable of automatically oscillating in the preselected frequencies in the first local oscillator, in such a way that in the first conversion the IF value is obtained for the preestablished TX's in the monitoring program. To clarify: when the equipment makes its sweep, or scan, of the frequencies in order to tune the previously selected transmitters TX's to be monitored, we need a local oscillator capable of oscillating in the corresponding frequencies in order to always obtain the same IF as a result in the conversion. This is achieved by means of a programmable digital synthesizer represented by a microcontroller capable of generating frequencies from 881.3 MHz to 906.7 MHz in increments of 200 KHz, with a software that allows preprogramming (of the 128 frequencies in the synthesizer) only those that we need; those that correspond with the transmitters will be monitored.

As an example, with a microcontroller as described, the equipment will be capable of monitoring 50 transmitters from the 902 MHz frequency to the 911.8 MHz frequency; subsequently, it will initiate another frequency sweep of the same transmitters. However, if we wish to eliminate transmitter number 25 from that loop, the equipment will be capable of making a scan from transmitter number one, in the 902 MHz frequency, to transmitter number 24 in the 906.6 MHz frequency; thereafter it will jump to the 907 MHz frequency corresponding to transmitter number 26, and so on, in 200 KHz increments, until reaching transmitter number 50 in the 911.8 MHz frequency. In this case 906.8 MHz was not tuned, and as a result transmitter number 25 was not monitored since it was not in the program. This programmable digital synthesizer will be capable of receiving from a main microcontroller (as mentioned previously) the information concerning how many transmitters should be monitored at any given point in time, within the 128 transmitter limit, and which should be removed from the monitoring function or sweep so there is a jump in the sweep when it reaches those transmitters.

Binary Code Identification Circuit

This monitoring equipment also has a binary identification code detection capability (unique and non-transferable) for each transmitter within the frequency modulation, as shown in the figures. This circuit performs the task, via an FM detector, of suppressing the radio frequency carrier and obtaining, in base band, the binary identification code transmitted by each transmitter. Then, through the triple line receiver, it will introduce the detected digital information into the microcontroller port. In parallel fashion, the binary code that is being monitored at a given point in time, as provided by the main microcontroller, will be introduced into another port. In such a way, each frequency being given by the digital synthesizer to each of the four receptors will correspond to the binary digital number assigned at that moment to the microcontroller. This results in obtaining the desired number in parallel fashion, which then is introduced into an eight input codifier in charge of converting this digital number into BCD. Afterwards, through a BCD to decimal decoder and LED drivers, we obtain the decimal number of the transmitter being monitored in the three 7-segment LED's.

Distance Measuring Circuit

This circuit is used to measure the distance from the central unit to the transmitter being monitored at any given point in time.

The IF signal at the output of the second IF amplifier feeds into a narrow pass band filter which has a 10.7 MHz central frequency. This eliminates the possible spurious frequency generated in the previous stage. Thus, the output at the filter gives a very clean 10.7 MHz IF signal. Then an input amplifier increases the level of this signal to the adequate level. Afterwards, the next stage converts this analog signal into a digital signal to be processed and measured by a logic circuit. This results in a strong signal originating from a nearby transmitter being represented digitally by a small number corresponding to the short distance that it is situated from the central unit. Conversely, a weak signal corresponding to a distant transmitter is represented by a larger digital number that is equivalent to the approximate distance, in feet, that the transmitting unit is situated in relationship to the central control unit.

This digital number corresponding to the various distances being monitored is represented in the upper right hand corner of the same LCD that is used to indicate the bearing of the transmitters. This is accomplished via two different inputs. In other words, the same LCD indicates bearing and distance.

Threshold Detector Circuit

The resulting signal at the FM detector output is compared in a threshold detector, with a reference voltage being given at one of the input detectors by the main microcontroller. This reference voltage has a determined value corresponding with the distance at which the transmitters are to be monitored. In other words, if we need to monitor the transmitters at 100 meters, the main microcontroller assigns to that distance a voltage reference value to one input of the threshold detector, and in the other input the signal of all transmitters being monitored appears one by one, so the signals can be compared to the voltage reference value. This will enable it to detect that a transmitter has left the range of the receiver, when the intensity of the transmitter signal received is less than the voltage reference value. The threshold detector provides an output voltage that is converted into an alarm signal for the equipment. This means that the threshold detector is in charge of determining the distance until past which the transmitters can draw away from the monitoring system.

This alarm signal or output voltage is used for various functions, as follows: (1) to start a sound and visual alarm system; (2) to stop the digital synthesizer in the frequency of the particular signal that the local oscillator tuned into; and (3) to stop the main controller in the binary identification code that was assigned to that frequency.

Audio and Visual Alarm Circuit

The sound alarm system is comprised of an oscillator that will produce any sound signal that one may wish: bells, sirens, or even the sounds produced by modern auto alarms. This signal is introduced into a controllable gain audio amplifier, which increases the power level of the signal to excite a 4" speaker placed at the front of the monitoring equipment. This signal at the output of the oscillator also appears at the rear panel of the equipment through a buffer. This allows for the use of an external and optional audio amplifier of greater power. The audio amplifier gain is controlled by the main microcontroller, and it is increased or decreased by the front panel of the central unit.

The visual alarm circuit is made up of a three 7-segment LED display, a LED driver, a decoder (BCD to decimal), and an astable oscillator. Each binary identification code corresponding with each of the transmitters monitored is decodified, converting the BCD into a decimal number which through the LED driver is represented in the three 7-segment LED's. This indicates the number of the transmitter that is being monitored in the circular LCD graticule. The function of the astable multivibrator is to generated a flashing (at the frequency of the multivibrator) decimal number represented in the three 7-segment LED's when the signal alarm at the threshold detector output is received. This flashing number is an indication that the transmitter represented by that decimal number is out of the maximum preestablished range in the monitoring equipment. At the same time, the astable output can be applied by means of a buffer into the gate of a triac that is connected in series with the 110 volt network (this can only be used through AC power). This allows for the use of a red external bulb of greater power, driven by the triac, flashing at the same frequency in unison with the 7-segment LED's. This allows the user to see the alarm when positioned away from the central unit. This is an optional feature of the equipment.

Once the alarm signal originating from the threshold detector has performed the three functions of activating the alarm system, stopping the digital synthesizer in the tuned frequency, and stopping the counter that establishes the binary identification code, it becomes necessary via the keypad on the main central control unit to erase the corresponding memory cell of said transmitter. After this is done, activating the scan mode on the keypad will reinitiate a new scan of all transmitters. However, the new scan will not include monitoring the transmitter that generated the alarm. Not doing so will force the system to stop again at the number that initiated the alarm signal.

Portable Unit

Once the bearing and distance of the transmitter out of range has been established by the central unit, the user will need to seek the bracelet out of range. However, keeping in mind that the bracelet wearer may not be stationary (the wearer may be moving in a different direction and distance from the originally detected position), as the user is moving it is necessary to use a hand held monitoring system to track the bracelet out of maximum range. This portable unit is smaller and performs fewer functions but has greater sensibility. The number of the bracelet sought is entered into the portable unit by means of a keypad and only that number is monitored for bearing.

This portable unit will only seek the bracelet whose number has been entered via the keypad. It does not have an alarm circuit (sound or visual) nor a threshold circuit. It has an LCD display identical to the one on the central unit, with a circular graticule, which allows for point to point monitoring establishing the bearing of the missing bracelet, and a distance indicator in the upper right hand corner that indicates in feet the actual distance from the portable unit to the transmitter that is being tracked.

The microcontroller used is the same as used in the central unit. Its functions, display, keypad and graticule are shown in the figures.

This portable unit is used with rechargeable batteries, so the user is able to walk with the unit, following the bearing of the missing transmitter. This rechargeable battery is charged by the central unit when the portable unit is not in use.

Description of the Embodiments

The present invention relates to a radio frequency (RF) security system with a direction and distance locator, a plurality of portable transmitters, and in an expanded embodiment, a portable search and locate unit.

The present system monitors the position and the distance of up to 128 portable transmitters within a range of approximately 1,000 feet. These transmitters may be worn by individuals, children, animals or inanimate objects if those inanimate objects are subject to security concerns. For example, in retail stores selling high-priced items (for example, furs or high-priced audio or video equipment), the transmitters may be mounted on the back side or underside of the inanimate objects. If an individual removes that inanimate object beyond the security zone or if a child wanders beyond the established security zone (up to 1,000 feet), the RF security system alarm would be activated. The operator may reduce the size of the security control zone. Each portable transmitter has a transmission circuit which continually emits both an FM modulated RF signal and an RF carrier signal. The FM signal is modulated by a unique transmitter unit code assigned to the portable transmitter.

Figure 2:
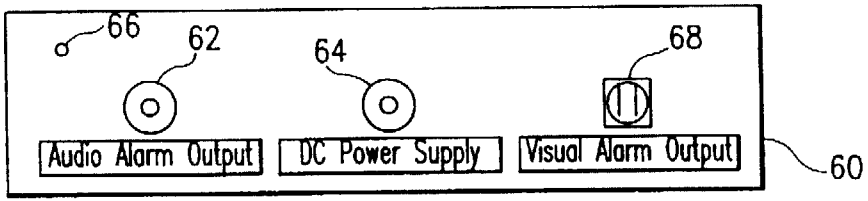
FIG. 2 diagrammatically illustrates the back panel of the central control unit.

FIG. 1 and FIG. 2 diagrammatically illustrate central unit 10. Central unit 10 includes a power on/off switch or indicator 12, four antennas 14*a*, 14*b*, 14*c* and 14*d*, a graduated by angle display 16 and a numerical display 18. The antennas 14*a*–14*d* are in a square or orthogonal array. In general, graduated display 16 shows the orientation or bearing between a portable transmitter (in FIG. 8) and the central control unit 10. A digital display 18 shows the transmitter unit code for the transmitter location and distance displayed on displays 16 and 21. For example, display 16 includes displayed point 20 representing unit 12. Distance is shown in region 21. If central unit 10 was located such that the vertical reticle on display 16 points north and the reticle at 90 degrees to the right points east, transmitter unit 12 is approximately north, northeast.

Central control unit 10 also includes an audible alarm represented by speaker 22, a further display 24 showing input bracelet or transmitter identification, and a keypad 26. Display 24, shown in detail in FIG. 1, shows battery status (square blocks), bracelet id number, wearer's name, security zone setting and volume setting. In addition to keypad 26, the control unit includes a number of buttons one of which is STORE button 28 and another of which is UP volume button 30. The following Control Unit Button Table provides examples of the types of user actuated controls which may be available on central control unit 10.

Control Unit Button Table

| | |
|---|---|
| Sto | Store |
| Clear | Clear entry or display |
| Rcl | Recall memory cell |
| Fcn | Function |
| Up/down | Increment/decrement volume |

The store, clear and recall buttons enable the operator to store a bracelet or portable transmitter unit code in the central unit thereby placing that unit code in the scan cycle table of the memory. The store control button is also utilized to input a name of the wearer of the transmitter. In this manner, the security system may be used by operators to track children within a store or within an entertainment area. If the child goes beyond the security zone (programmable up to 1,000 feet), the alarm system would go off and the control unit would display the errant transmitter unit code who has left the security zone boundary, on the three 7-segment LED's.

Keypad 26 enables the operator to input the numerical transmitter unit code and the alphabetic characters representing the name of the wearer. As used herein, the term "keypad" includes the alphanumeric keys shown in area 26 in FIG. 1 and the controls 28 (store, clear, recall and function) as well as the volume controls 30.

The function control on the central control unit enables the operator to program the microprocessor within the central control unit. The table entitled "Central Control Unit Function Table" provides some examples of these types of functions.

Central Control Unit Function Table

| | |
|---|---|
| Function 1 | Enter PIN (personal id #) |
| Function 2 | Store names and bracelet numbers |
| Function 3 | Battery indicator |
| Function 4 | Enter time, date, year |
| Function 5 | Clear cell in memory |
| Function 6 | Enable scan mode |
| Function 7 | Backlight (on/off) |
| Function 8 | Alarm volume |
| Function 9 | Set security zone distance |

In the illustrated embodiment, central control unit 10 includes a cradle 40 within which is placed the portable (handheld) locator control unit diagrammatically illustrated in FIG. 3. In addition to cradle 40 formed by central control unit 10, the central control unit includes a data connection or communication port as well as a power transfer port. In one embodiment, central control unit 10 is powered by common 120 volt AC power. It may also include a backup battery which enables the RF security system to maintain power even if the common AC power is disrupted. In contrast, the portable search and locate unit illustrated in FIG. 3 has a rechargeable battery therein. Since the portable search and locate unit normally resides in cradle 40, the rechargeable battery in the search and locate unit is continually recharged by appropriate circuitry (not shown) in the central control unit.

The central control unit may include a day, date and time clock and display as well as a battery strength indicator. The security zone range may also be displayed in display 24.

FIG. 2 diagrammatically illustrates a portion of the back panel 60 of central control unit 10. Central control unit 10 includes an audio alarm output 62, a DC power supply input 64 and an AC power plug 66. In addition, the back side of central control unit 60 may include visual alarm output jack 68. Audible alarm jack 62 and visual alarm jack 68 enables the central control unit 10 to be connected to external audio alarm systems (amplifiers, receivers and speakers) as well as visual alarms (lamps, strobes, neon signs) which, when a portable transmitter passes beyond the security zone, are activated.

In FIG. 1, antennas 14*a*–14*d* are not extended. In use, those antennas would be extended to their maximum height. As stated earlier, the present system has been designed to operate at the 900 MHz frequency band. The antennas are configured in an array such that the height 1 of the antenna when extended (antenna 14*d*) is much smaller that the wavelength of the RF frequency signal generated by the portable transmitters. Additionally, the antennas are configured in a special array such that the distance d between each antenna (for example the distance between antenna 14*a* and 14*c*) is less than or equal to one-half of the wavelength of the RF carrier signal. The following Antenna Table establishes these parameters.

Antenna Table

A. Extended height 1 of antenna (the dipole) is much smaller than wavelength $1 \ll \lambda$ B. Distance d between antennas is less than or equal to one-half wavelength $d \leqq (1/2)\lambda$ The phase difference between 14*a* and 14*c* is the differential of coordinate x, $\delta x = 2\pi f\ d \cos \phi$ and the phase difference between 14b and 14d is the differential of coordinate y, $\delta y=2\pi f \cos \theta$, where f is the frequency of the received signal. $\phi+\theta$ are equal to 90 degrees. Then $\delta x=2\pi f d \sin \theta$ and $\delta y=2\pi f \cos \theta$, and x, y are the coordinates of the transmitter relative to the central control unit. The differentials $\delta x$ and $\delta y$ become x and y coordinates of a vector of amplitude $2\pi f$ and argument $\theta$. The amplitude will be proportional to the frequency f of the monitored transmitter and the argument $\theta$ will be the angle or bearing of the transmitter relative to the central control unit.

FIG. 3 diagrammatically illustrates the portable search and locate unit 70. As explained above, this unit may be disposed in cradle 40 of central control unit 10. Otherwise, the search and locate unit 70 may be totally independent and may be held in its own cradle distant and apart from central control unit 10. The portable search and locate unit includes four antennas in an array, one of which is antenna 72. The unit also includes a graduated display 74, another display 76, and keypads 78 and user actuated control buttons 80. Display 76 includes battery strength indicator, time, bracelet id, wearer's name and backlight on/off status. Search and locate unit 70 has a graduated by angle display 74 in order to locate the approximate bearing of an errant transmitter unit. Display 76 may show a time and date clock and a battery strength indicator. As shown in display region 74, a transmitter unit has been detected as shown by image point 75. That image shows that the transmitter unit 12 (illuminated in display region 76) is approximately north, northeast (assuming the same orientation as described above in connection with central control unit 10) and approximately 120 feet from the operator. Distance is shown in region 71. The operator is carrying the portable search and locate unit 70. Transmitter unit 12, carried by child Smith in this illustrated embodiment, is about 120 feet away from unit 70. The antennas shown in FIG. 3 are compressed and have not been extended. LCD display 74 shows the transmitter with a dot and shows the distance to the transmitter as a numeric value.

Figure 4:
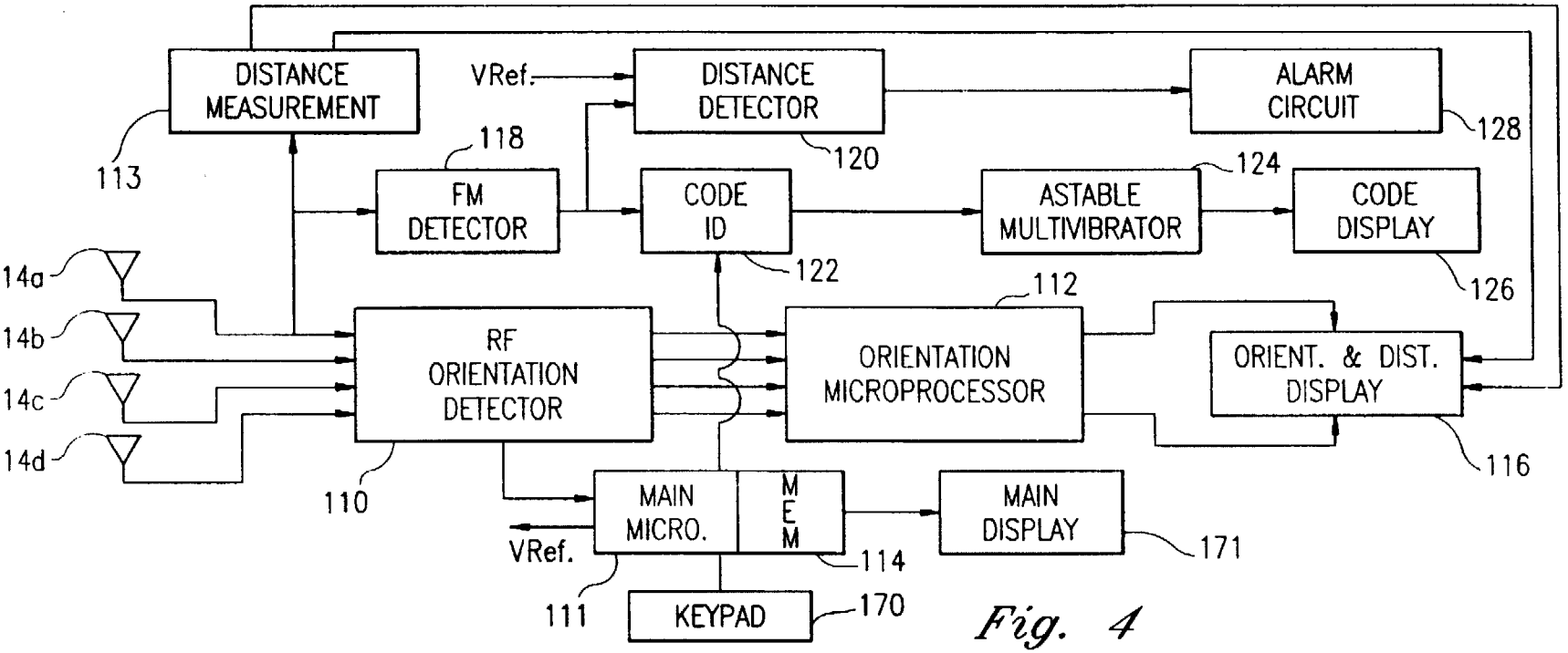
FIG. 4 is a block diagram showing the major components in the central control unit.

FIG. 4 diagrammatically illustrates, in block diagram form, the major electronic components of the central control unit. The central control unit includes an antenna system consisting of antennas 14a, 14b, 14c and 14d. These antennas capture modulated RF signals as well as RF carrier signals generated by the portable transmitters. These received RF signals are fed to an RF orientation detector circuit 110. The output of the orientation detection circuit 110 is fed to an orientation microprocessor 112. As discussed later, orientation detection or directional detection circuit 110 generates a plurality of phase differential signals which are indicative of the spatial orientation of each transmitter unit relative to the central control unit. The RF orientation detection unit or directional detection unit searches or scans for each transmitter in the security zone based upon a scan control. The scan control signal is generated by main microprocessor 111 (and associated memory 114). Keypad 170 and main display 171 are also connected to main microprocessor 111. In the preferred embodiment, the scan control corresponds to a unit code which represents the RF carrier and the unique TX code in each transmitter. Microprocessor 111 obtains each transmitter code from memory 114 during a scan cycle and applies this transmitter code as a scan control to the RF orientation and directional detection circuit 110. The RF orientation unit demodulates the received modulated RF signal based upon the scan control by the digital synthesizer.

Microprocessor 112 uses an algorithm to detect the orientation or bearing of the transmitter having that unique unit code. Microprocessor 112 outputs display commands to an orientation display 116. In FIG. 1, orientation display 116 is a graduated by angle LCD (liquid crystal display) display 16. Other types of displays could be utilized including a CRT monitor.

Since all of the antennas 14a–14d in the antenna system detect the same FM modulated RF signal from a particular transmitter, only one of the antennas 14a is electrically connected to an FM detection circuit 118, and its output is also applied to a distance measurement circuit 113. The output of the distance measurement circuit is supplied to display 116. The output of the FM detector is coupled to a distance detector circuit 120. The distance detector or out-of-range detector circuit 120 is supplied with a reference voltage v-ref generated by microprocessor 111. The output of the FM detection circuit is fed to a distance detector 120 as well as a code identification circuit 122. The scan control line carrying the unique transmitter code is also applied to code identifier circuit 122. In operation, the FM detector 118 extracts the modulation signal from the RF carrier received by the antenna system. The demodulated signal from detector 120 represents the received transmitter unit code. Accordingly, after this demodulated information signal is converted from analog to digital, the digital word can be compared against the unit transmitter code generated by microprocessor 111 as the scan control signal. The code identification circuit 122 compares the extracted unit code with the unit code (scan control signal) obtained from memory 114 and microprocessor 111. If the comparison is accurate, the output is applied to a switch 124 and ultimately to code display 126. In the illustrated embodiment, code display 126 corresponds to three 7-segment LED (light emitting diode) display 18 in FIG. 1

Distance detector 120 accomplishes two general functions. First, it determines whether the portable transmitter has exceeded the security zone. This is done with a threshold circuit which utilizes the output of the FM detector. When the output of the FM detector 118 falls below a certain signal level, the threshold detector fires, generates an alarm and activates not only switch 124 but also alarm circuit 128. As discussed below, alarm circuit 128 may be both an audio alarm and a visual alarm or may be one type of alarm. Further, these alarm signals can be applied to external audio and visual elements.

Switch 124 may be further utilized such that after the threshold circuit fires indicating that the transmitter is out of range, code display 126 flashes or is excessively illuminated to notify the operator that a transmitter has left the security zone.

Figure 5:
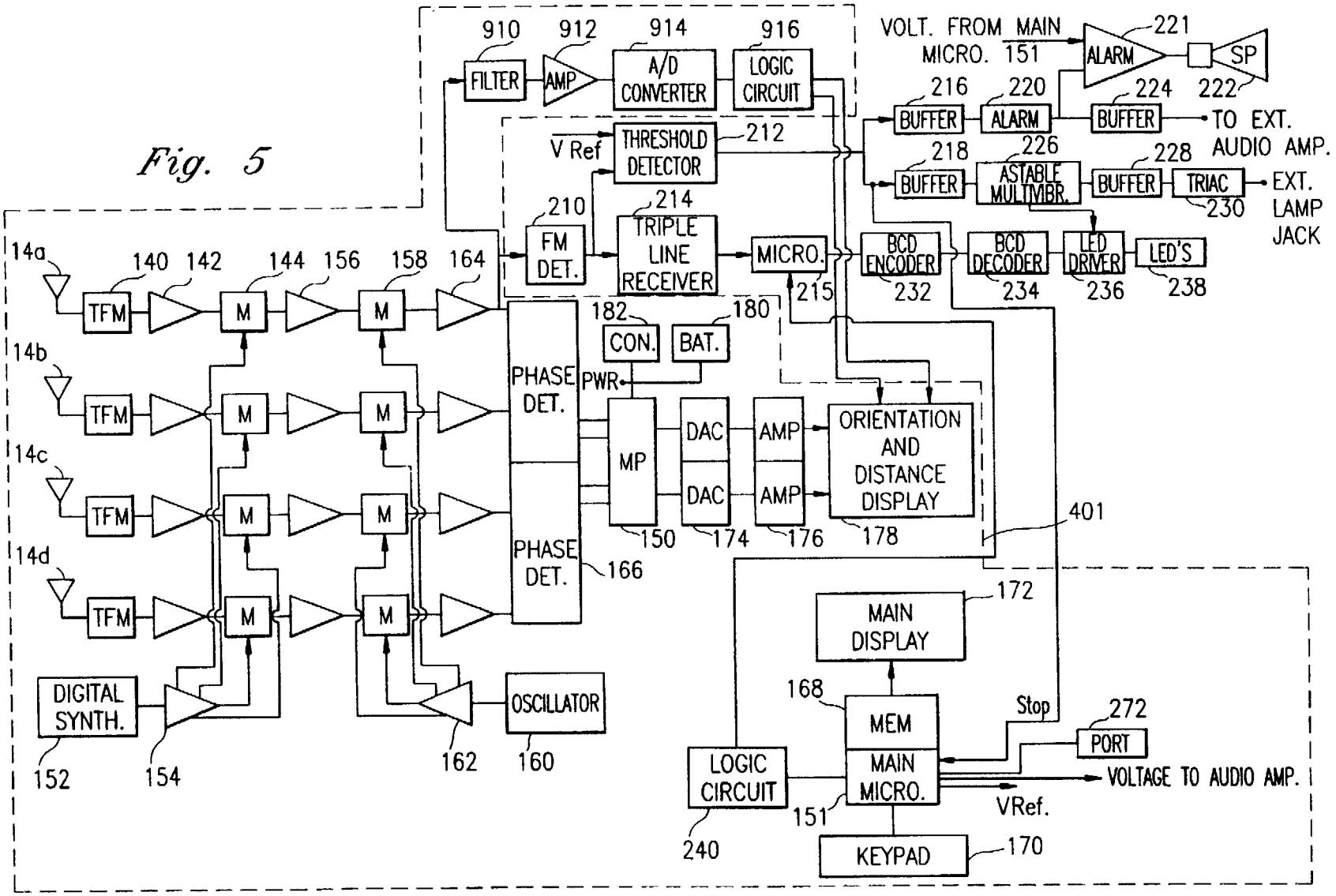
FIG. 5 is a detailed block diagram showing the components in the central control unit.

A detailed block diagram of the central control unit is illustrated in FIG. 5. The central control unit is capable of continually monitoring up to 128 bracelets or portable transmitters. In the event that any of the bracelets are tampered with, destroyed or cut, or removed intentionally or unintentionally from the security area, both a visual alarm and an audible alarm are activated by the central control unit. The audible alarm is emitted from speaker 22 in FIG. 1. In addition, the visual alarm and audio alarm signals could be applied to external audio and visual elements.

The central control unit also has a distance control command which enables the operator to set the size of the security zone. Although the security zone discussed herein is approximately 1,000 feet, the operator may wish to reduce the size of the zone. This is accomplished simply by adjusting the reference voltage applied to the threshold detection circuit discussed later herein.

In one embodiment, the central control unit will also include rechargeable batteries. In this manner, the central control unit and a number of portable transmitter units could be taken outdoors during school field trips, to amusement parks, national parks or other recreational areas which do not provide AC power. The AC power plug 66 and the DC power jack 64 shown in FIG. 2 could be utilized in this manner. Central control unit 10 may be powered from an automobile's DC power system via jacks 64. Appropriate power conversion circuits would be utilized.

As shown in FIG. 5, the central control trait includes an antenna system which includes an orthogonal array of antennas 14*a*–14*d*. Since each of these four antennas has a similar detection circuit associated therewith, only the RF detection circuit associated with antenna 14*a* will be discussed. Each antenna feeds the received RF signal into a double conversion FM receptor or receiver. Antenna 14*a* is connected to a transformer or a coupling circuit 140. The output of the coupling circuit is applied to a radio frequency amplifier 142. The output of the amplifier is applied to a mixer 144. Mixer 144 has two inputs, one for the RF carrier, and another for the local oscillator (digital synthesizer). Microprocessor 151 outputs a scan control to a logic circuit 240 which represents the unique transmitter unit code. This scan control is applied to a digital synthesizer 152, which feeds to the mixer 144 the corresponding frequency to scan. The output of the digital synthesizer is applied to a distribution amplifier 154. The distribution amplifier receives the frequency signals from the digital synthesizer and distributes the signals into the four different mixing stages of each receiver circuit associated with antennas 14*a*–14*d*. Optionally, a simple splitter may be used instead of the distributed amplifier. The distribution amplifier used in one embodiment of the invention is a PDA 10, 1 GHz amplified from Pico Macore, Inc. The output of this amplifier is applied to all the mixers M in the antenna and RF detection circuits. Particularly, this analog signal applied to mixer 144 represents the transmitter unit code scanned at that moment. The output of mixer 144 is an intermediate frequency signal. This intermediate frequency (IF) signal is applied to amplifier 156. The amplified IF signal is applied to a second mixer M 158. The second mixer is supplied with another RF signal ultimately generated by crystal oscillator 160. The output of crystal oscillator 160 is applied to distribution amplifier 162. It could be also a simple splitter. The output of mixer 158 is applied to a second IF amplifier 164.

The coupling circuit 140 is an inductive type coupling circuit and the coupling factor is chosen to be low. This avoids antenna influences in the tuning circuits of the receiver. The main functions of the coupling circuit are (a) to couple the antenna to the RF amplifier and (b) to limit frequencies in the receptor input in order to avoid interference. The RF amplifier will be a tuned amplifier with an approximate band of 26 MHz. This type of amplifier is capable of amplifying 128 FM modulated RF carriers spaced 200 KHz apart. Each transmitter in the system generates a different RF signal. The RF amplifier circuit will reduce spurious signal action and undesirable interferences with the receptor. It also reduces by means of attenuation the radiation of the first local oscillator so as to not interfere with the nearby receptors. The RF amplifier also increases the sensitivity of the receptor by amplifying only the desirable frequencies. The RF amplifier improves the signal to noise ratio of the receiver. The RF amplifier should be a low noise amplifier in order to improve this overall receiving relationship. Mixer 144 translates the RF carrier to a lower fixed frequency identified as an intermediate frequency. This enables the detection circuit to provide greater stability but also to enable the amplifiers to work in lower, non-audible frequencies. Greater gain and greater selectivity are provided by this double conversion. The second stage of the RF detection circuit, intermediate frequency amplifiers 156, 164, enables the control unit to have higher gain and selection characteristics. The IF amplifiers work at a much lower frequency. Consequently, there is an increase in capacitive reactance and a decrease in feedback in the receiver circuits. Accordingly, gain in the system is increased.

The receiver is a double conversion type because the antennas are detecting RF frequencies in a range between 902 and 928 MHz, that is, in the 900 MHz band. It is difficult for the coupling input circuit to eliminate image frequency because this frequency is very close to the working frequencies in the receiver. It is necessary to make a frequency change or conversion in the receiver in order to reduce or eliminate image frequency in the intermodulation products.

In one working embodiment, oscillator 160 operates at 10 MHz.

The outputs of each antenna detection circuit is fed to a phase detector 166. Several phase detectors may be used. The output of the phase detector provides signals representing Cartesian coordinates of the portable transmitter unit within the security zone. These phase differential signals are fed to microprocessor 150.

Returning to main microprocessor 151, memory 168 provides data and program storage for microprocessor 151. One function of memory 168 is to maintain a table or a list of all active transmitter units which are active within the security zone. A transmitter is "active" when the operator inputs the transmitter unit code into the central control unit. Microprocessor 151 scans through or looks up each one of these active unit codes and provides a scan control signal to digital synthesizer 158 as well as to another microcontroller discussed later in connection with the decoder circuit. Memory 168 is also used in conjunction with keypad 170 and data port 172.

Returning to the display circuitry, microprocessor 150 develops an output for LCD display 178 which provides both the direction or orientation of the receded RF signal. These display command signals are applied to a digital to analog convertor 174. The output of the D to A convertor 174 is applied to an amplifier bank 176. The output of amplifier 176 is applied to LCD display 178. The LCD display is similar to display 16 shown in FIG. 1. The x,y coordinates of the portable transmitter unit operating within the security zone as well as the distance of that unit away from the central control unit is shown on the graduated display 16. In one embodiment, the phase differential signals also include information indicating the distance to the transmitter.

As an example, the security system can be set at 500 feet to show all transmitters within the 500 feet range if 10 transmitters were active, graduated by angle display 16 shows 10 different points sequentially as the microprocessor cycles through the 10 unique codes stored in memory 168. The operator sees the general bearing and distance of each of those 10 transmitters within the 500 feet range. Simultaneously, the operator sees each transmitter unit code via display 18.

Microprocessor 150, in addition to all the other electrical components in the central control unit, is powered by either an AC source, converted to the appropriate DC level, or a battery 180. It is necessary to convert AC power to a DC voltage level and filter and smooth that power. Those power circuits are not shown in this diagram. Those power circuits are known to persons of ordinary skill in the art. In addition, the system includes a power connection port 182. Connection port 182 is used in conjunction with the search and locate unit 70 shown in FIG. 3. Connection port 182 is utilized to recharge rechargeable battery shown later in conjunction with the search and locate unit.

The output of the detection circuit from intermediate frequency amplifier 164 is applied to an FM detector 210. The output of the FM detector is applied to a threshold detection circuit 212 and is also applied to a three or triple line receiver 214. The threshold detector 212 is applied a reference voltage v-ref from microprocessor 151. This reference voltage establishes the signal strength or threshold which each modulated RF signal must meet in order to be classified "within the security zone". The reference voltage sets the size of the security zone. This voltage v-ref is adjustable by the operator. When the signal strength from the demodulated RF signal from each transmitter unit falls below that threshold, the alarm circuit is activated. The alarm circuit is activated by threshold detector 212 generating an alarm command. The alarm command is fed to microprocessor 151 as a "stop scan" command. The alarm command is also fed to buffers 216, 218. The output of buffer 216 is applied to audio alarm circuit 220 and ultimately to speaker 222 via amplifier 221. Amplifier 221 is also fed a control voltage from microprocessor 151. The output from alarm circuit 220 is applied to a further buffer 224. The output of buffer 224 is applied to a jack or electrical port which enables an external audio system to be coupled to the central control unit.

Returning to buffer 218, its output is applied to an astable multivibrator which is configured as an astable flip-flop 226. The output of multivibrator 226 is applied to a buffer 228 and to LED driver 236. The output of buffer 228 is applied to a triac 230. The triac output is coupled to an external lamp which is configured as a visual alarm.

The central control circuit also includes a decoder circuit which begins at triple line receiver 214. A triple line receiver 214 is manufactured by Texas Instruments as part number SN75124. The triple line receiver introduces the decoded transmitter unit code into a microcontroller. It enables the digital electronic circuit to decode, determine and extract the digital version of the transmitter unit code from the FM modulated RF signal from each transmitter. The output of the triple line receiver is applied to a microcontroller 215. A scan control signal is also applied to microcontroller 215 from logic circuit 240 and main microprocessor 151. This microcontroller in the present embodiment is manufactured by Phillips as part number 87C451. The output of the microcontroller is applied to a BCD encoder 232. The output of BCD encoder 232 is applied to a BCD to decimal decoder 234. The output of decoder circuit 234 is applied to an LED driver 236. Driver 236 applies the decoded transmitter unit code to a display which is LED display 238. Display 238 shows the scanned transmitter unit code. Upon alarm, the multivibrator 226 enables LED driver 236 such that upon enablement, the driver applies the flashing command for the transmitter unit code to LED display 238.

FM detector 210 suppresses the RF carrier signal and obtains from that base band the identification code transmitted by each transmitter in the security zone. The triple line receiver introduces the detected digital information into the microcontroller 215 port. In a parallel manner, the unit code that is being monitored by the RF detection circuit is also being provided by microprocessor 150 to microcontroller 215. This is identified in FIG. 5 as a scan control. In this way, the demodulated RF information signal is compared against the scan control representing the unit code currently being demodulated by the RF detection portion of the central controller.

In the present embodiment, the distance detection circuit includes a narrow band filter 910 (10.7 MHz central frequency), amplifier 912, analog to digital converter 914 and logic circuit 916. The distance circuit is fed a RF carrier signal from the output of amplifier 164. The output of logic circuit 916 is applied to LCD display 178. In this embodiment, the distance to a transmitter is shown as a numerical number on LCD display 178. In another embodiment, the distance may be displayed on a separate LED display.

Microprocessor 151 is also connected to logic circuit 240. The output of logic circuit 240 generates the scan control. Logic circuit 240 also generates certain other information signals.

Figure 6:
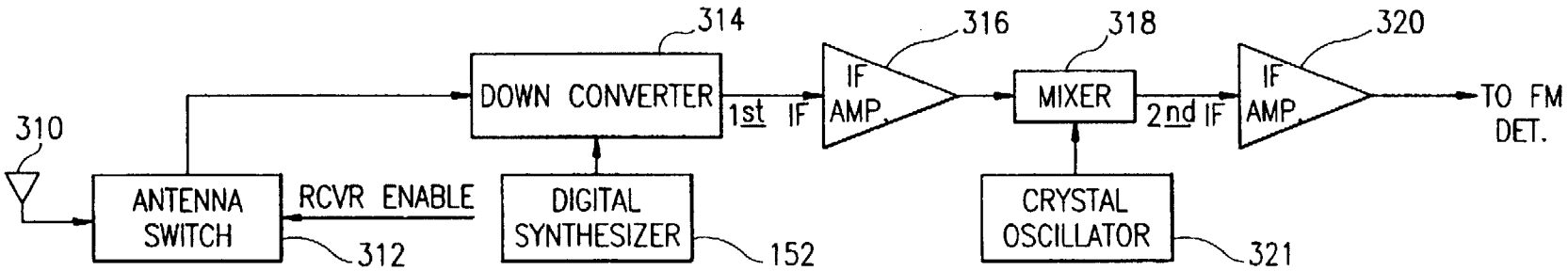
FIG. 6 diagrammatically illustrates the major components of another RF orientation detection circuit.

FIG. 6 diagrammatically illustrates another option for the RF receiver or detection portion of the central controller. Antenna 310 has an output applied to antenna switch 312. The antenna switch may be manufactured by Motorola as discussed below in the Component Part Table. A receiver enable command is applied to antenna switch 312. The output of the antenna switch is applied to a down convertor 314. The down convertor is applied to an intermediate frequency amplifier 316 which in turn is connected to mixer 318 which is also in turn connected to a second IF amplifier 320. A crystal oscillator 321 feeds a fixed signal to mixer 318. The output of IF amplifier 320 is applied to FM detector 210 as shown in FIG. 5. The down convertor 314 is supplied with the output of the digital synthesizer 152. As discussed above in connection with FIG. 5, the digital synthesizer is supplied with a scan control ultimately emanating from microprocessor 150. With the system disclosed in FIG. 6, three stages of receiver coupling and radio frequency amplification and mixing is provided. These components are all manufactured by Motorola as the series MRFIC system. The series complies with frequency, common noise level, sensitivity and other parameters necessary for the central control unit discussed above. The following Component Table provides some information regarding components used in this embodiment of the present invention.

Component Part Table

| | |
|---|---|
| 3x line receiver | Texas Instruments SN75124 |
| Microcontroller | Phillies 87C451 |
| Multivibrator (MV) | Astable flip-flop |
| Antenna switch | Motorola MRFIC 2003 |
| Down convertor | Motorola MRFIC 2001 |
| Up convertor | Motorola MRFIC 2002 |
| Driver (bracelet) | Motorola MRFIC 2004 |

Figure 7:
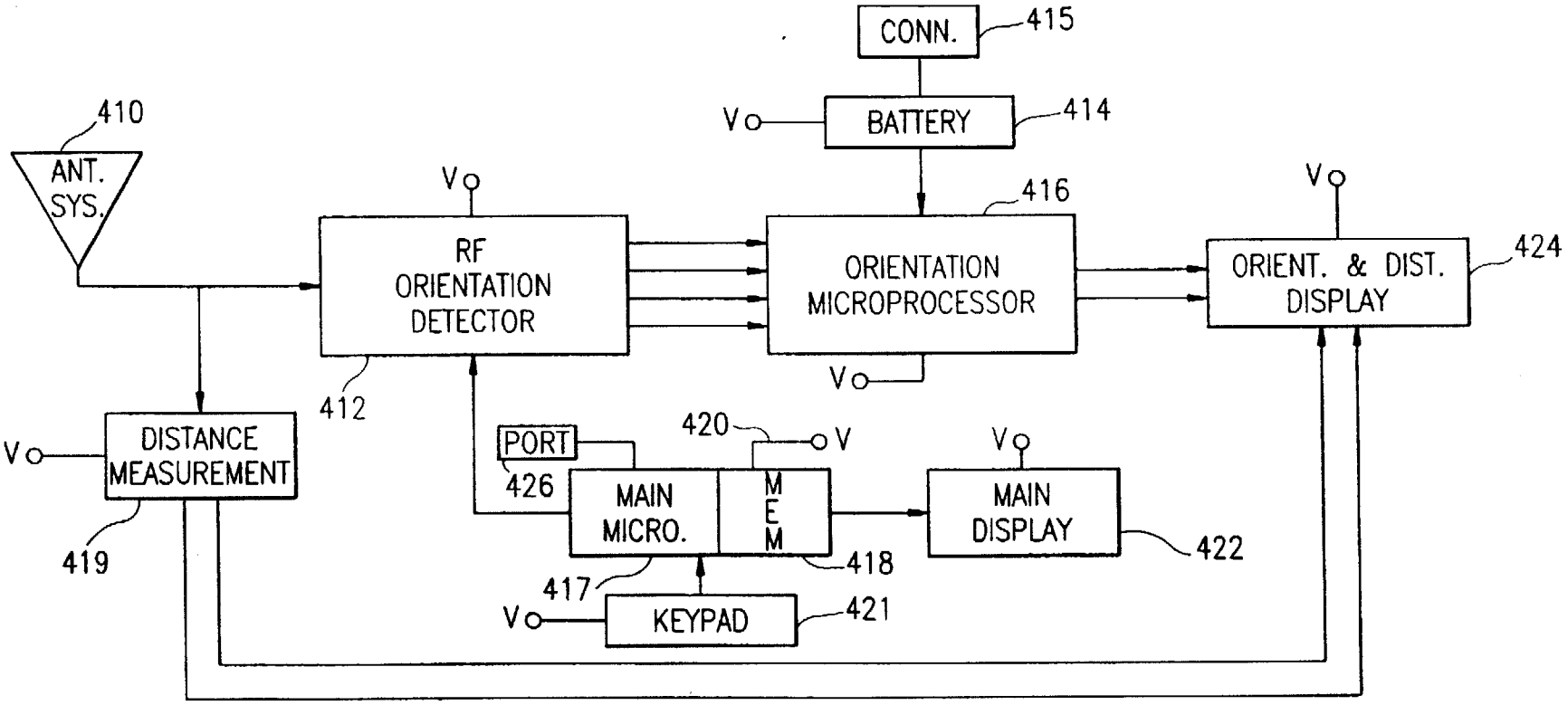
FIG. 7 is a block diagram showing the major components of the portable search and locate unit (FIG. 3)

FIG. 7 diagrammatically provides a block diagram of the portable search and locate unit shown in FIG. 3. In general, the detailed components of the portable search and locate units are found in the portion of FIG. 5 identified within dashed line 401.

FIG. 7 shows that the portable search and locate unit includes an antenna system 410 coupled to a radio frequency orientation detection circuit 412. The detection circuit is supplied with a voltage v. This voltage v is supplied from battery 414. The output of the RF orientation detection circuit 412 is applied to an orientation microprocessor 416. A main microprocessor 417 has an associated memory 418. The microprocessor 417 generates a scan control which is applied to the RF orientation detection circuit 412. Microprocessor 417 is also supplied power via power line 420. Microprocessor 417 obtains input from a keypad 421. Keypad 421 is I supplied voltage v. Microprocessor 417 also develops information for bracelet code display 422. Code display 422 corresponds to LED display 76 in FIG. 3. Microprocessor 416 develops display commands for orientation LCD display 424. Microprocessor 417 also is coupled to a data port 426. The data port 426 complements data port 272 in FIG. 5. In this manner, it is possible to transfer information between the portable search and locate unit 70 and the central control unit 10. This information may represent an errant transmitter unit code. An "errant transmitter" is a transmitter that has left the security zone. The rechargeable battery 414 is charged via connector 415. Connector 415 in the portable search and locate unit is complementary to connector 182 in the central control unit shown in FIG. 5.

The antenna system is also connected to distance measurement circuit 419. The output of circuit 419 is applied to display 424 such that the distance is displayed to the errant transmitter.

The portable search and locate unit operates substantially similar to the central control unit. The antenna system is configured in an orthogonal array. The outputs of each of these four antennas are fed through first and second mixers and tuner stages in order to receive the FM modulated RF signal developed by and received by the antennas. The received signals are fed to a phase detector circuit similar to phase detector 166 in FIG. 5. The outputs of the phase detectors are applied to the microprocessor. The microprocessor determines the orientation or the bearing of the errant transmitter and displays that orientation or bearing on display screen 74 in FIG. 3. The display screen also shows the distance from the portable search and locate unit to the errant transmitter unit. This is accomplished through a similar routine as described above with respect to the central control unit. The signal strength is measured at the signal input of the phase detectors.

In order to activate the portable search and locate unit, the operator lifts unit 70 from cradle 40 (FIG. 1) and inputs the tracking unit code into keypad 78. If more than one transmitter is errant or lost, the operator would input multiple tracking unit codes via keypad 78. These codes represent the transmitter codes and are stored in memory 418. The codes are used in the scan cycle executed by microprocessor 417. During each scan cycle, microprocessor 417 displays the transmitter unit code on display screen 76 which is represented as 422 in FIG. 7. Recall, store, function and clear buttons are explained above in connection with the central control unit and have similar uses.

In a preferred embodiment, the search and locate unit's display 76 continuously displays the single errant transmitter and the name of the person wearing the bracelet.

Figure 8:
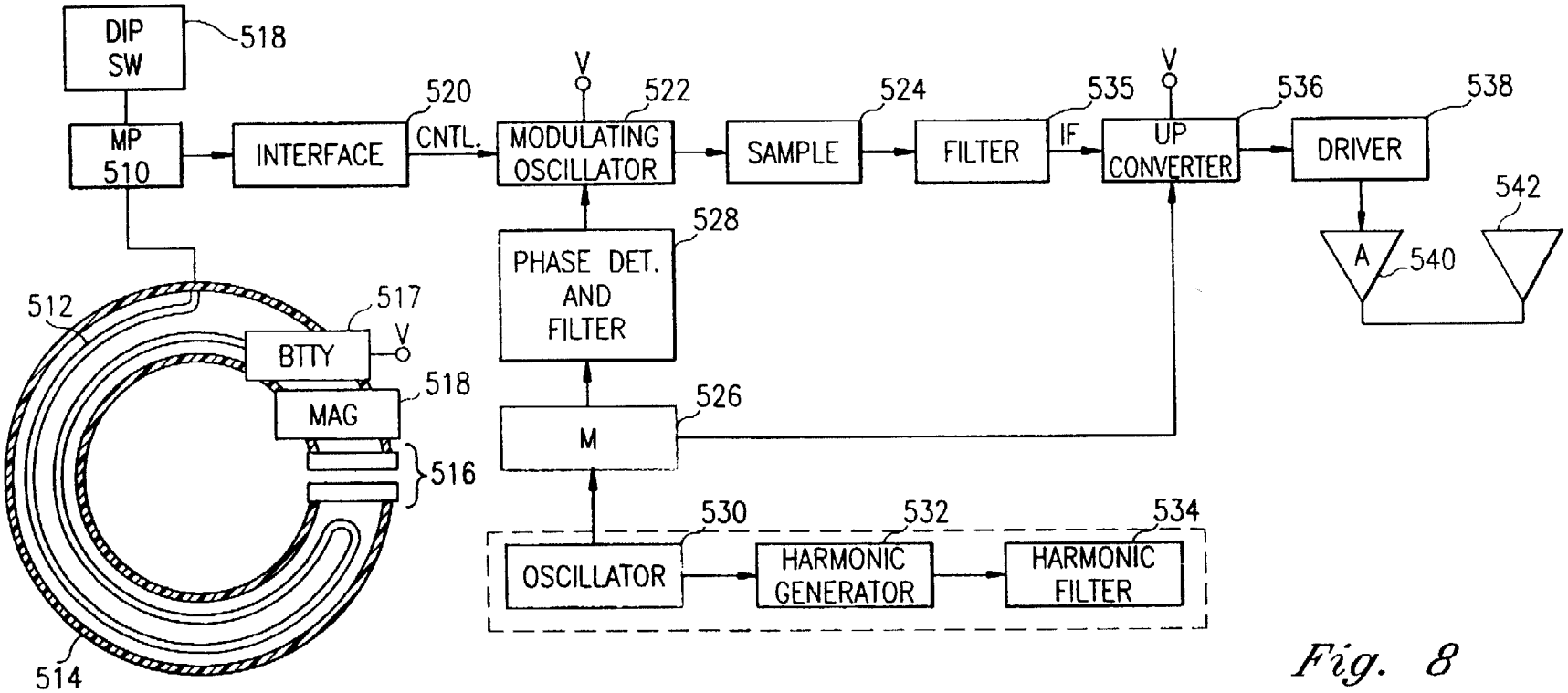
FIG. 8 is a detailed block diagram showing the portable transmitter.

FIG. 8 diagrammatically illustrates major components in the portable transmitter. The portable transmitter includes a microprocessor 510 which is supplied with power via a power cord 512. In one embodiment, the power cord 512 is carried by a band 514. This band has a lockable latch 516. Accordingly, the band can be placed around the wrist or ankle of a child or other user. The child or other user may wander around the security zone without setting off the RF security alarm of the central control unit or station. Microprocessor 510 is supplied with power via power line 512 running through most of the band. Battery 517 (nickel cadmium or lithium) supplies power to power line 512 but also supplies power at a voltage port v to the other components.

Microprocessor 510 has a unique transmitter code set by DIP switch 518. The output of microprocessor 510 is applied to an interface 520. The output of interface 520 provides a control signal to modulating oscillator 522. A power voltage v is applied to modulating oscillator 522. Modulating oscillator 522 includes a phase lock loop circuit consisting of sampling unit 524, mixer 526 and phase detector and filter 528. Mixer 526 is supplied with a carrier signal from crystal oscillator 530. Crystal oscillator 530 also outputs a signal to harmonic generator 532 whose output is attached to harmonic filter 534. The output of harmonic filter 534 is applied to an up convertor 536.

The output of sampling unit 524 is applied to a filter 535. The output of filter 535 is an intermediate frequency or IF signal. The up convertor enhances or ratchets up that IF signal to the 900 MHz RF band. The output of up convertor 536 is applied to a driver 538. The output of driver 538 is applied to an amplifier 540. Amplifier 540 is used to drive the RF signal to antenna 542. The transmitter's maximum power is 0.5 watts. The bandwidth of each transmitter is about 100 KHz to avoid interference.

With this system, if the person wearing the portable transmitter band severs or cuts the band, power to microprocessor 510 is eliminated. However, power is not disrupted to oscillator 522 and the other RF generating components. Accordingly, the RF carrier signal is still emitted by the transmitter and ultimately by antenna 542. If power is normally supplied to microprocessor 510, that microprocessor ultimately modulates the carrier signal such that the FM modulated RF signal generated by the transmitter contains a transmitter unit code. This information signal containing the transmitter unit code is detected and ultimately decoded by the central control unit.

The transmitter also includes a magnetic strip 518 that can be used to activate an exit alarm system if the transmitter passes through an exit alarm system near a door or exit passage. The transmitter and bracelets are waterproof. The electronic components are disposed in an unbreakable casing. Antenna 542 may be encased in bracelet 514.

Returning to the central control unit, if the portable transmitter has been tampered with such that a modulated RF signal is not being transmitted, the central control unit may be able to detect the orientation and distance of that partially obliterated transmitter via the RF carrier. The phase detector circuit 166 in FIG. 5 may be able to detect the orientation of the RF carrier signal. Further, the distance between the central control unit and the partially altered bracelet and transmitting unit may be obtained based on the strength of the carrier signal. The strength of the carrier signal could be detected at the input of, phase detector 166 in FIG. 5.

Further, the central control unit will stop the scan cycle when the unique transmitter code received and decoded by that unit from the received RF signal does not match the unit code supplied to microcontroller 215 from memory 168 during the scan cycle. Both the code extracted from the modulated RF signal and the code supplied by microprocessor 150 to microcontroller 215 must match. On the other hand, if threshold detector 212 senses that the demodulated RF signal is too small, thereby indicating that the portable transmitter is outside the security zone, a stop command signal is applied to microprocessor 150. This stops the scan cycle and the LED display 238 flashes to show the last transmitter code which caused the cycle to stop. This enables the operator, upon hearing or seeing the alarm, to look at the central control unit and quickly identify which bracelet or transmitting unit is outside the security zone.

In a like manner, if the portable transmitter has been tampered with and the portable transmitter is no longer emitting the modulated RF signal but instead is emitting the RF carrier signal, the central control unit would quickly identify what bracelet or portable transmitter unit is affected and the scan would stop at that tampered unit's identification number.

The operator would clear the cell in the memory of the central unit (function 5) and then enable the scan mode (function 6), so the central unit will scan all the transmitter codes again. If another errant transmitter code is detected, the alarm will sound and the operator will be notified of the new errant transmitter unit code.

Figure 9:
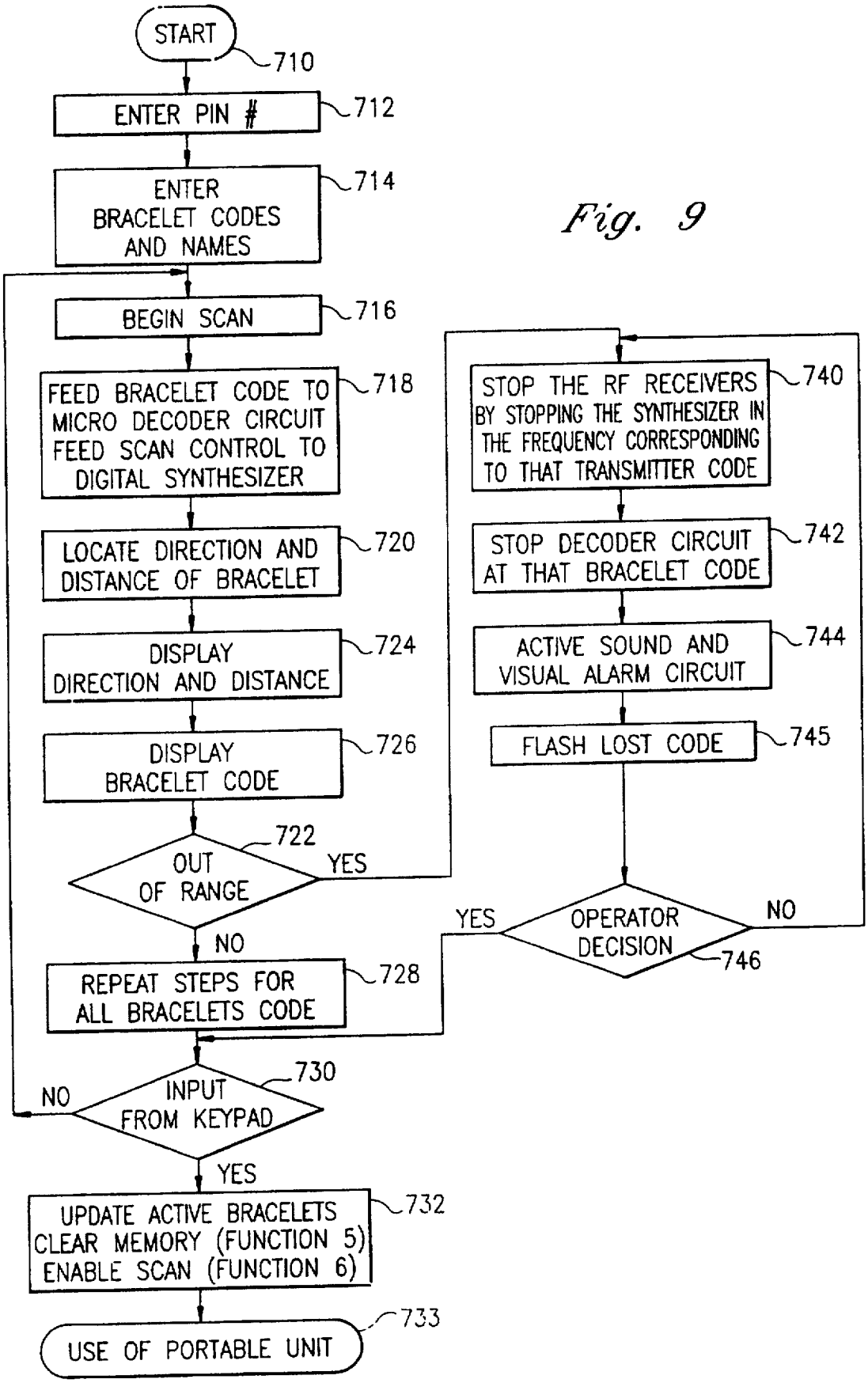
FIG. 9 diagrammatically illustrates a flow chart showing the major program steps for the central control unit.
Figure 10:
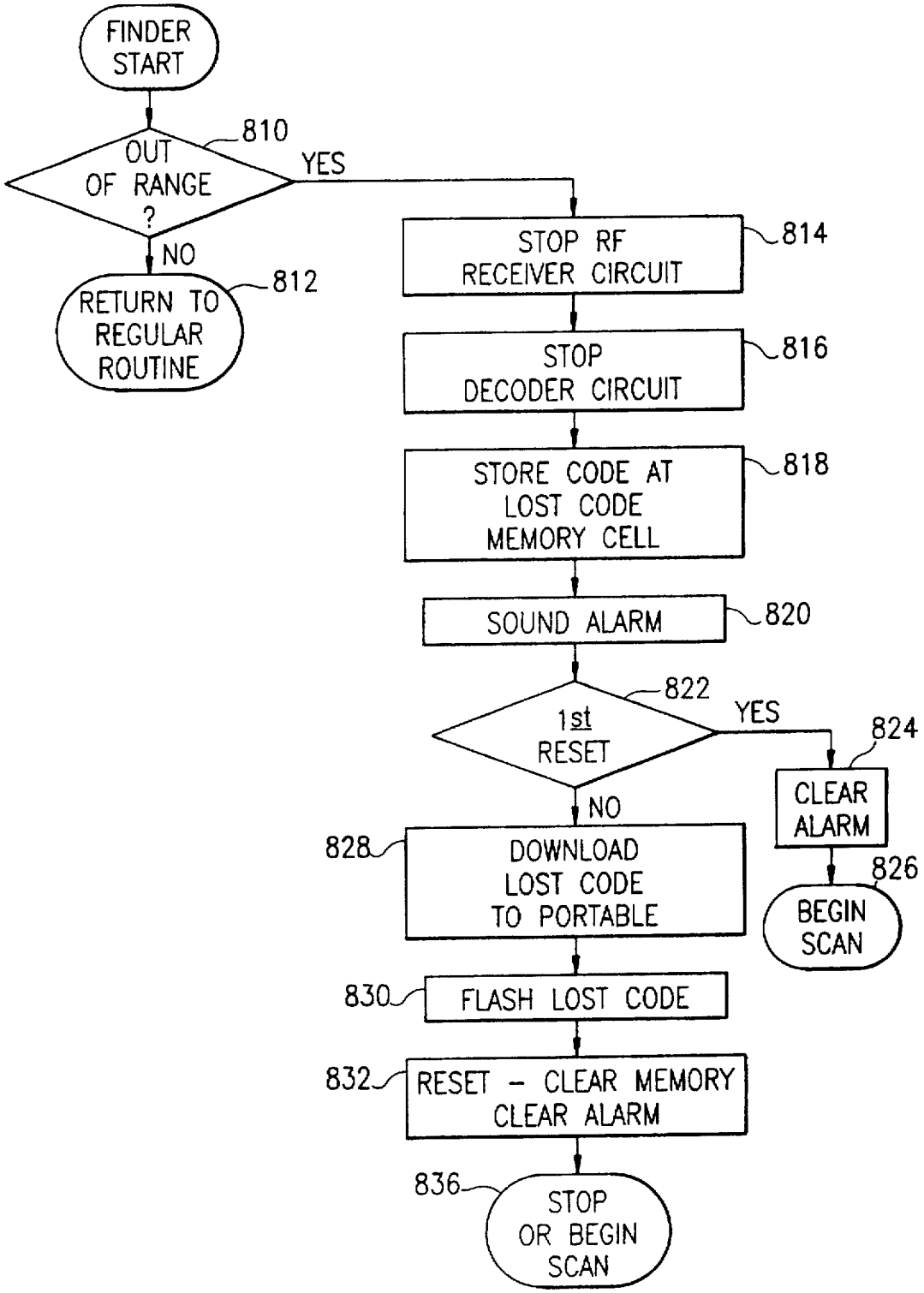
FIG. 10 diagrammatically illustrates a flow chart showing a finder routine which may supplement the general flow chart for the central control unit.

FIGS. 9 and 10 show flow charts illustrating the major operating or processing steps for the present invention. In FIG. 9 the system starts at step 710. In step 712 the operator enters his or her personal identification number (PIN). In step 714, the operator enters one or more unique transmitter codes or bracelet codes into the central control unit. The transmitter code is then "activated". As discussed above, the operator utilizes keypad 26 to enter the name of the wearer of the bracelet.

As an alternate embodiment, a simple data transfer can occur between the portable transmitter and the central control unit. This may be accomplished by bar code scanning or an electrical contact and matching electrical connectors in the portable transmitter as well as the central control unit. In this embodiment, the operator would strike the store button when the portable transmitter has been bar code scanned or when the complementary contacts are in place.

In step 716, the central control unit begins scanning. Step 718 indicates that the microprocessor feeds or applies the scan control signal, which is the bracelet code, to the micro decoder circuit feed scan control to the digital synthesizer (RF receiver circuit and the decode circuit). Step 720 determines the direction or orientation of the bracelet transmitter and the distance between the central control unit and the portable transmitter. Steps 724 and 726 display the direction and the distance and the bracelet code on various displays. Step 722 determines whether the portable transmitter is out of range. If the NO branch is taken, step 728 repeats all steps for all bracelet codes. Decision step 730 determines whether there has been any input from the keyboard. If the NO branch is taken, the system jumps to a point prior to begin scan step 716. If the YES branch is taken, the system in step 732 updates the active bracelet or active transmitter unit codes in the memory, boosts or amplifies the distance detection circuit, stops the scan, clears the memory (function 5), enables the scan (function 6) or executes other functions identified above. Optionally, the program may branch and jump to the use of portable unit step 733. Otherwise, the program returns to step 716.

Returning to decision step 722, if the bracelet or transmitter is out of range, the YES branch is taken. Step 740 stops the radio frequency receiver circuit by stopping the synthesizer in the frequency corresponding to that transmitter code. In step 742, the microprocessor stops the decode circuit at that bracelet code. This enables the system to display the bracelet or transmitter code that is out of range or that has been tampered with. In step 744, the alarm circuit (audio and visual) is activated. In step 745, that code is displayed as a flashing visual alarm. Decision step 746 determines the action of the operator. If the YES branch is taken, the system returns to the keypad decision step 730. If the NO branch is taken, the system continues with the alarm loop and returns to step 740.

As disclosed herein, the present invention can be digitized to a high degree. Some of the functions performed by the circuits can be integrated into a microprocessor and a computer program. Other of the functions must be carried out by discrete components such as the RF detection circuit. Some of the software functions may be carried out with discrete logic circuits.

Incorporation of a reset button to the central control unit results in a new flow chart. FIG. 10 illustrates a modification of a flow chart shown in FIG. 9. The enhanced process shown in FIG. 10 is the finder routine. The finder routine begins at decision step 810 which is generally similar to decision step 722 in FIG. 9. If an out-of-range signal is not detected, the NO branch is taken and the system returns in step 812 to the regular routine shown in FIG. 9. If the bracelet or transmitter has been determined to be out of range, the YES branch is taken and in step 814 the microprocessor stops the RF receiver circuit. In step 816, the microprocessor stops the decoder circuit. At step 818 the errant or tampered transmitter code is stored at a "lost code" memory cell or location. In step 820, the alarm is activated. Decision step 822 determines whether the operator has depressed the reset button a first time. If the YES branch is taken, the system clears the alarm in step 824 and in step 826 the scan is resumed through the scan cycle. If the operator has selected the reset button a second or third time, the NO branch is taken and step 828 downloads the lost code signal to the portable search and locate unit shown in FIG. 3. In step 830, the central display unit begins flashing the lost code to the user. This constitutes a visual alarm. In step 832, the user resets the system, clears the memory and clears the alarm. In step 836, the system stops or begins the scan cycle again.

Figure 11:
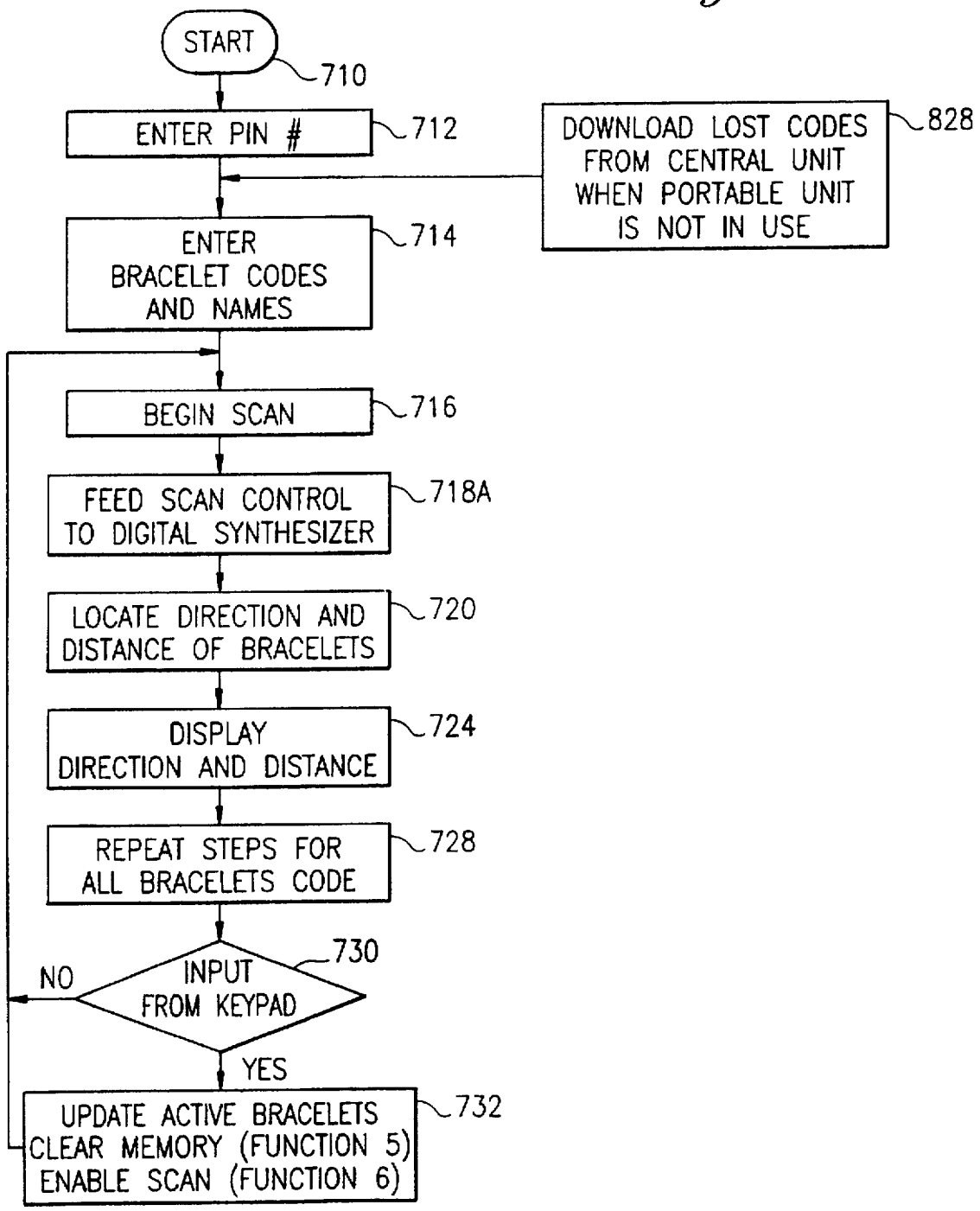
FIG. 11 illustrates the flow chart for the portable unit.

FIG. 11 diagrammatically illustrates the flow chart for the portable locator unit. The system starts at start step 710. In step 712, the user enters the identification or pin number. In step 828, which is an optional step, the central unit downloads lost bracelet codes from the central unit when the portable unit is not in use. In step 714, the user enters the bracelet codes and names. This manual entry is not necessary if the automatic data entry is performed in step 828. In any event, in step 716, the portable unit begins a scan. In step 718A, the scan control signal is fed to the digital synthesizer by the microprocessor. In step 720, the circuitry locates the direction and distance between the errant bracelets and the portable search or locator unit. In step 724, the portable unit displays the direction and the distance. In step 728, the system repeats for all bracelet codes entered in the data entry step. In decision step 730, a decision is made whether there is any input from the user in the keypad. The NO branch returns the system to the begin scan step 716. The YES branch executes step 732 which updates lost bracelets, clears memory (function 5), enables scan (function 6) and any other function the user may actuate. The system then returns to the begin scan step 716.

Figure 12:
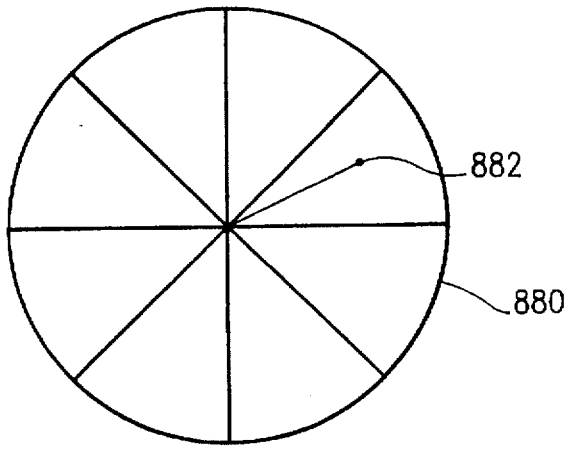
FIG. 12 illustrates another reticle.

FIG. 12 diagrammatically illustrates another display reticule 880. In this situation, rather than displaying the distance, the lined image 882 is displayed which graphically illustrates the distance between the central control unit and the transmitter within the scanning range.

Another possible function of distance detector 120 (FIG. 4) is to provide a distance signal back to a microprocessor. This distance signal is obtained from the input of the FM detector 118. The distance output signal is mixed with the orientation signal obtained by the phase differential output by orientation detection circuit 112. The distance signal and orientation signal are mixed such that the orientation display 116 (LCD display 16 in FIG. 1) shows not only the orientation or bearing of the transmitter found during the scan but also the distance between the central control unit and the transmitter. Alternatively, display 116 may show the distance to the transmitter as a numeric value. The orientation to the transmitter may be an image line (FIG. 1) or a dot on the display screen.

Another way to detect the distance is to determine the signal strength of the signal output by phase detector 166 (FIG. 5). This would entail using an analog to digital convertor intermediate phase detector 166 and a microprocessor. Another way to determine the distance for orientation and bearing display 178 is to utilize an analog to digital convertor at the output of FM detector 210. The digital output of the A to D convertor would then be applied to a microprocessor. The microprocessor utilizes an algorithm to determine orientation based upon the phase differential and a further algorithm to determine distance based upon signal strength. These two information signals are mixed together for the display commands for display 178. Since signal strength is inversely related to the distance between the central unit and the portable transmitters, the microprocessor would have an algorithm to convert the signal strength data into relative distance data.

Further enhancements can be made to the central control system. For example, the reference voltage v-ref applied to threshold detector 212 could be modified in a step-wise fashion. This would enable the microprocessor to determine where each transmitter unit is located based upon the firing time of the detector 212 and the stepped reference voltage. For example, the first threshold band may be 0 to 200 feet away from the central controller. The second band may be 200–500 feet. The third band may be 500–1,000 feet. By stepping through threshold bands in this security zone, the central control unit could provide varying degrees of security clearance to transmitter units at predetermined distances away from the central unit.

The claims appended hereto are meant to cover modifications and changes within the spirit and scope of the present invention.

What is claimed is:

1. A radio frequency (RF) security system with a direction and distance locator comprising:

a central control unit;

said central control unit including a power output port;

a plurality of portable transmitters in radio frequency communication with said central control unit, each portable transmitter unit having a unique unit code assigned thereto, and each portable transmitter unit including:

a microcontroller supplied with the respective unit code for said portable transmitter unit and having means for generating an RF control signal representative of said respective unit code;

a power supply electrically coupled to said microcontroller via a power line;

an elongated band with a lockable latch mechanism, said band carrying said power line thereon such that upon severance of said band, said powerline is similarly severed;

a modulatable RF transmitting circuit, including an antenna, being coupled to said microcontroller and being modulated by said RF control signal, said transmitting circuit generating a modulated RF signal based upon said RF control signal and generating an RF carrier signal in the absence of said RF control signal, said transmitting circuit being coupled to said power supply independent from said power line carried by said band;

said central control unit including:

a microprocessor coupled to a memory, said memory storing all unit codes therein, said microprocessor generating unit code commands representative of said unit codes;

a keypad input device, coupled to said microprocessor, for inputting unit codes into said memory via said microprocessor;

an antenna system, including a plurality of antennas in an array, receiving said modulated RF signal from each transmitter unit and generating a received modulated RF signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon the corresponding received modulated RF signal;

said microprocessor having means for converting said phase differential signals into display commands representing the relative position and means for determining the relative strength of the received modulated RF signal from each transmitter unit;

a first display, coupled to said microprocessor, receiving said display commands and displaying a directional and distance image for the respective portable transmitter unit;

a threshold detection circuit, coupled to said antenna system and said microprocessor, said threshold detection circuit receiving said received modulated RF signal and determining when that signal falls below a predetermined signal strength level and generating an alarm command;

a decoder circuit, coupled to said microprocessor and said antenna system, said decoder circuit decoding receiving said received modulated RF signal, extracting said unit code therefrom and comparing the extracted unit code to said unit code command received from said microprocessor, said decoder circuit including means for generating a unit code display command representing said unit code;

a second display, coupled to said decoder circuit, for displaying an image representing said unit code based upon said unit code display command; and said microprocessor having means for generating unit code commands for all transmitter units such that said RF directional detection circuit and said threshold detection circuit scans for all RF modulated signals based upon said unit codes stored in said memory;

said RF security system further including:

a portable search and locate unit, said portable locate unit including:

a power input port complementary to said power output port on said central control unit;

a microprocessor coupled to a memory, said memory storing one or more tracking unit codes therein, said tracking unit codes representing unit codes for portable transmitter units subject to a search and locate mission, said microprocessor generating corresponding unit code commands representative of said tracking unit codes;

a keypad input device, coupled to said microprocessor, for inputting said tracking unit codes into said memory via said microprocessor;

an antenna system, including a plurality of antennas in an array, receiving said modulated RF signal from each transmitter unit and generating a received modulated RF signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon the corresponding received modulated RF signal;

said microprocessor having means for converting said phase differential signals into display commands representing the relative position and means for determining the relative strength of the received modulated RF signal from each transmitter unit;

a first display, coupled to said microprocessor, receiving said display commands and displaying a directional and distance image for the respective portable transmitter unit;

a second display, coupled to said microprocessor, for displaying an image representing said unit code based upon said tracking unit code command; and said microprocessor having means for generating tracking unit code commands for all transmitter units subject to said search and locate mission such that said RF directional detection circuit scans for all RF modulated signals based upon said tracking unit codes stored in said memory.

2. A security system with a direction and distance locator as claimed in claim 1 wherein said microprocessor includes means for cycling through all unit codes stored in said memory and including means for stopping said cycling means upon receipt of said alarm command.

3. A radio frequency (RF) security system with a direction and distance locator comprising:

a central control unit;

a plurality of portable transmitters in radio frequency communication with said central control unit, each portable transmitter unit having a unique unit code assigned thereto, and each portable transmitter unit including:

a microcontroller supplied with the respective unit code for said portable transmitter unit and having means for generating an RF control signal representative of said respective unit code;

a power supply electrically coupled to said microcontroller via a power line;

an elongated band with a lockable latch mechanism, said band carrying said power line thereon such that upon severance of said band, said power line is similarly severed;

a modulatable RF transmitting circuit, including an antenna, being coupled to said microcontroller and being modulated by said RF control signal, said transmitting circuit generating a modulated RF signal based upon said RF control signal and generating an RF carrier signal in the absence of said RF control signal, said transmitting circuit being coupled to said power supply independent from said power line carried by said band;

said central control unit including:

a microprocessor coupled to a memory, said memory storing all unit codes therein, said microprocessor generating unit code commands representative of said unit codes;

a keypad input device, coupled to said microprocessor, for inputting unit codes into said memory via said microprocessor;

an antenna system, including a plurality of antennas in an array, receiving one of said modulated RF signal and said RF carrier signal from each transmitter unit and respectively generating a received modulated RF signal and a received RF carrier signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon the corresponding received modulated RF signal;

said microprocessor having means for converting said phase differential signals into display commands representing the relative position and means for determining the relative strength of the received modulated RF signal from each transmitter unit;

a first display, coupled to said microprocessor, receiving said display commands and displaying a directional and distance image for the respective portable transmitter unit;

a threshold detection circuit, coupled to said antenna system and said microprocessor, said threshold detection circuit receiving said received modulated RF signal and determining when that signal fails below a predetermined signal strength level and generating an alarm command, in a first instance, and generating said alarm signal when said threshold detection circuit receives said received RF carrier signal in a second instance;

a decoder circuit, coupled to said microprocessor and said antenna system, said decoder circuit, in said first instance, decoding receiving said received modulated RF signal, extracting said unit code therefrom and comparing the extracted unit code to said unit code command received from said microprocessor, said decoder circuit including means for generating a unit code display command representing said unit code, and said decoder circuit, in said second instance, receiving said unit code command from said microprocessor and said means for generating said unit code display command;

a second display, coupled to said decoder circuit, for displaying an image representing said unit code based upon said unit code display command; and said microprocessor having means for generating unit code commands for all transmitter units such that said RF directional detection circuit and said threshold detection circuit scans for all RF modulated signals based upon said unit codes stored in said memory and having means for cycling through all unit codes stored in said memory and including means for stopping said cycling means upon receipt of said alarm command.

4. A security system with a direction and distance locator as claimed in claim 3 including an amplifier, for enhancing the display commands and said first display.

5. A security system with a direction and distance locator as claimed in claim 4 including an alarm system coupled to said threshold detection circuit, said alarm system comprising at least one of an audio alarm and a visual alarm.

6. A security system with a direction and distance locator as claimed in claim 5 including electrical ports coupled to said alarm system, said ports adopted to output said alarm command to an external alarm system electrically coupled to said security system via said ports.

7. A security system with a direction and distance locator as claimed in claim 3 including means for resetting said cycling means subsequent to stopping the scan cycle with said means for stopping.

8. A security system with a direction and distance locator as claimed in claim 3 wherein said central control unit includes a power output port;

said RF security system including:

a portable search and locate unit, said portable locate unit including:

a power input port complementary to said power output port on said central control unit;

a microprocessor coupled to a memory, said memory storing one or more tracking unit codes therein, said tracking unit codes representing unit codes for portable transmitter units subject to a search and locate mission, said microprocessor generating corresponding unit code commands representative of said tracking unit codes;

a keypad input device, coupled to said microprocessor, for inputting said tracking unit codes into said memory via said microprocessor;

an antenna system, including a plurality of antennas in an array, receiving said modulated RF signal from each transmitter unit and generating a received modulated RF signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon the corresponding received modulated RF signal;

said microprocessor having means for converting said phase differential signals into display commands representing the relative position and means for determining the relative strength of the received modulated RF signal from each transmitter unit;

a first display, coupled to said microprocessor, receiving said display commands and displaying a directional and distance image for the respective portable transmitter unit;

a second display, coupled to said microprocessor, for displaying an image representing said unit code based upon said tracking unit code command; and said microprocessor having means for generating tracking unit code commands for all transmitter units subject to said search and locate mission such that said RF directional detection circuit scans for all RF modulated signals based upon said tracking unit codes stored in said memory.

9. A security system with a direction and distance locator as claimed in claim 3 wherein said central control unit includes a power output port;

said RF security system including:

a portable search and locate unit, said portable locate unit including:

a power input port complementary to said power output port on said central control unit;

a microprocessor coupled to a memory, said memory storing one or more tracking unit codes therein, said tracking unit codes representing unit codes for portable transmitter units subject to a search and locate mission, said microprocessor generating corresponding unit code commands representative of said tracking unit codes;

a keypad input device, coupled to said microprocessor, for inputting said tracking unit codes into said memory via said microprocessor;

an antenna system, including a plurality of antennas in an array, receiving one of said modulated RF signal and said RF carrier signal from each transmitter unit and respectively generating a received modulated RF signal and a received RF carrier signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon one of the corresponding received modulated RF signal and the received RF carrier signal;

said microprocessor having means for converting said phase differential signals into display commands representing the relative position and means for determining the relative strength of the received RF signal from each transmitter unit;

a first display, coupled to said microprocessor, receiving said display commands and displaying a directional and distance image for the respective portable transmitter unit;

a second display, coupled to said microprocessor, for displaying an image representing said unit code based upon said tracking unit code command; and said microprocessor having means for generating tracking unit code commands for all transmitter units subject to said search and locate mission such that said RF directional detection circuit scans for all RF signals based upon said tracking unit codes stored in said memory.

10. A security system with a direction and distance locator as claimed in claim 9 including an amplifier, for enhancing said display commands and said first display.

11. A security system with a direction and distance locator as claimed in claim 8 including an amplifier, for enhancing said display commands and said first display.

12. A radio frequency (RF) security system with a direction and distance locator comprising:

a central control unit;

a plurality of portable transmitters in radio frequency communication with said central control unit, each portable transmitter unit having a unique unit code assigned thereto, and each portable transmitter unit including:

a microcontroller supplied with the respective unit code for said portable transmitter unit and having means for generating an RF control signal representative of said respective unit code;

a power supply electrically coupled to said microcontroller via a power line;

an elongated band with a lockable latch mechanism, said band carrying said power line thereon such that upon severance of said band, said power line is similarly severed;

a modulatable RF transmitting circuit, including an antenna, being coupled to said microcontroller and being modulated by said RF control signal, said transmitting circuit generating a modulated RF signal based upon said RF control signal and generating an RF carrier signal in the absence of said RF control signal, said transmitting circuit being coupled to said power supply independent from said power line carried by said band;

said central control unit including:

a microprocessor coupled to a memory, said memory storing all unit codes therein, said microprocessor generating unit code commands representative of said unit codes;

a keypad input device, coupled to said microprocessor, for inputting unit codes into said memory via said microprocessor;

an antenna system, including a plurality of antennas in an array, receiving one of said modulated RF signal and said RF carrier signal from each transmitter unit and respectively generating a received modulated RF signal and a received RF carrier signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon one of the corresponding received modulated RF signal and the received RF carrier signal;

said microprocessor having means for converting said phase differential signals into display commands representing the relative position and means for determining the relative strength of the received RF signal from each transmitter unit;

a first display, coupled to said microprocessor, receiving said display commands and displaying a directional and distance image for the respective portable transmitter unit;

a threshold detection circuit, coupled to said antenna system and said microprocessor, said threshold detection circuit receiving said received modulated RF signal and determining when that signal falls below a predetermined signal strength level and generating an alarm command, in a first instance, and generating said alarm signal when said threshold detection circuit receives said received RF carrier signal in a second instance;

a decoder circuit, coupled to said microprocessor and said antenna system, said decoder circuit, in said first instance, decoding receiving said received modulated RF signal, extracting said unit code therefrom and comparing the extracted unit code to said unit code command received from said microprocessor, said decoder circuit including means for generating a unit code display command representing said unit code, and said decoder circuit, in said second instance, receiving said unit code command from said microprocessor and said means for generating said unit code display command;

a second display, coupled to said decoder circuit, for displaying an image representing said unit code based upon said unit code display command; and said microprocessor having means for generating unit code commands for all transmitter units such that said RF directional detection circuit and said threshold detection circuit scans for all RF signals based upon said unit codes stored in said memory and having means for cycling through all unit codes stored in said memory and including means for stopping said cycling means upon receipt of said alarm command.

13. A security system with a direction and distance locator as claimed in claim 12 including an amplifier, having a gain control actuated by an operator, or enhancing said display commands and said first display.

14. A security system with a direction and distance locator as claimed in claim 13 including an alarm system coupled to said threshold detection circuit, said alarm system comprising at least one of an audio alarm and a visual alarm.

15. A security system with a direction and distance locator as claimed in claim 14 including electrical ports coupled to said alarm system, said ports adopted to output said alarm command to an external alarm system electrically coupled to said security system via said ports.

16. A security system with a direction and distance locator as claimed in claim 12 including means for resetting said cycling means subsequent to stopping the scan cycle with said means for stopping.

17. A security system with a direction and distance locator as claimed in claim 16 wherein said central control unit includes a power output port;

said RF security system including:

a portable search and locate unit, said portable locate unit including:

a power input port complementary to said power output port on said central control unit;

a microprocessor coupled to a memory, said memory storing one or more tracking unit codes therein, said tracking unit codes representing unit codes for portable transmitter units subject to a search and locate mission, said microprocessor generating corresponding unit code commands representative of said tracking unit codes;

a keypad input device, coupled to said microprocessor, for inputting said tracking unit codes into said memory via said microprocessor;

an antenna system, including a plurality of antennas in an array, receiving one of said modulated RF signal and said RF carrier signal from each transmitter unit and respectively generating a received modulated RF signal and a received RF carrier signal representative thereof;

an RF directional detection circuit, coupled to said antenna system and said microprocessor, said directional detection circuit receiving said unit code commands from said microprocessor and having means for generating phase differential signals indicative of a corresponding spatial orientation of each transmitter unit relative to said central control unit based upon one of the corresponding received modulated RF signal and the received RF carrier signal;

said microprocessor having means for converting said phase differential signals into display commands representing the relative position and means for determining the relative strength of the received RF signal from each transmitter unit;

a first display, coupled to said microprocessor, receiving said display commands and displaying a directional and distance image for the respective portable transmitter unit;

a second display, coupled to said microprocessor, for displaying an image representing said unit code based upon said tracking unit code command; and said microprocessor having means for generating tracking unit code commands for all transmitter units subject to said search and locate mission such that said RF directional detection circuit scans for all RF signals based upon said tracking unit codes stored in said memory.

18. A security system with a direction and distance locator as claimed in claim 17 including an amplifier, having a gain control actuated by an operator, coupled intermediate said means for converting said phase differential signals into display commands and said first display such that the directional and distance image for the respective portable transmitter unit subject to said search and locate mission and showing the relative position and the relative strength of the received RF signal is magnified.

* * * * *